US011458472B2

(12) United States Patent
Reis et al.

(10) Patent No.: US 11,458,472 B2
(45) Date of Patent: Oct. 4, 2022

(54) LIQUID FLOW CONTROL

(71) Applicant: Biosurfit, SA, Lisbon (PT)

(72) Inventors: Nuno Alexandre Esteves Reis, Lisbon (PT); Tania Moura Pires De Andrade Tenreiro, Lisbon (PT); Miguel Joao Marques Barreiros, Lisbon (PT)

(73) Assignee: Biosurfit, SA, Lisbon (PT)

( * ) Notice: Subject to any disclaimer, the term of this patent is extended or adjusted under 35 U.S.C. 154(b) by 469 days.

(21) Appl. No.: 16/708,845

(22) Filed: Dec. 10, 2019

(65) Prior Publication Data

US 2020/0156061 A1 May 21, 2020

Related U.S. Application Data

(62) Division of application No. 15/618,436, filed on Jun. 9, 2017, now Pat. No. 10,525,470.

(30) Foreign Application Priority Data

Jun. 9, 2016 (GB) ..... 1610102
Jun. 9, 2016 (PT) ..... 109453
(Continued)

(51) Int. Cl.
*B01L 3/00* (2006.01)
*B01F 29/15* (2022.01)
(Continued)

(52) U.S. Cl.
CPC ..... *B01L 3/50273* (2013.01); *B01F 29/15* (2022.01); *B01F 33/30* (2022.01);
(Continued)

(58) Field of Classification Search
CPC ..... B01L 3/50273; B01L 3/502715; B01L 3/502723; B01L 3/502746;
(Continued)

(56) References Cited

U.S. PATENT DOCUMENTS 6,143,248 A 11/2000 Kellogg
6,235,531 B1 5/2001 Kopf-Sill et al.
(Continued)

FOREIGN PATENT DOCUMENTS

CA 2925839 A1 4/2015
DE 10 2005 048233 A1 4/2007
(Continued)

OTHER PUBLICATIONS

Ducrée et al., "The centrifugal microfluidic Bio-Disk platform," J. Micromech. Microeng., 2007, 17, S103-S115.
(Continued)

*Primary Examiner* — Samuel P Siefke
(74) *Attorney, Agent, or Firm* — Patterson Thuente Pedersen, P. A.

(57) ABSTRACT

A liquid handling device having an axis of rotation about which the device can be rotated to drive liquid flow. The device includes a vented upstream chamber having an outlet port and an unvented chamber including an inlet port to receive liquid from the outlet port of the upstream chamber and an outlet port radially outward the inlet port. The device further includes a vented downstream chamber having an inlet port to receive liquid from the outlet port of the unvented chamber. A downstream conduit connects the outlet port of the unvented chamber to the inlet port of the downstream chamber and includes a bend radially inward of the outlet port of the unvented chamber. An upstream conduit connects the outlet port of the upstream chamber to the inlet port of the unvented chamber.

7 Claims, 18 Drawing Sheets

(30) Foreign Application Priority Data

Oct. 7, 2016 (GB) ..... 1617083
Oct. 7, 2016 (PT) ..... 109662

(51) Int. Cl.
*B01F 33/30* (2022.01)
*B04B 9/10* (2006.01)
*B04B 11/02* (2006.01)
*B04B 15/08* (2006.01)

(52) U.S. Cl.
CPC ... *B01L 3/502715* (2013.01); *B01L 3/502723* (2013.01); *B01L 3/502746* (2013.01); *B04B 9/10* (2013.01); *B04B 11/02* (2013.01); *B04B 15/08* (2013.01); *B01L 2200/0605* (2013.01); *B01L 2200/0621* (2013.01); *B01L 2200/0684* (2013.01); *B01L 2300/0803* (2013.01); *B01L 2300/0883* (2013.01); *B01L 2400/0406* (2013.01); *B01L 2400/0409* (2013.01); *B01L 2400/082* (2013.01)

(58) Field of Classification Search
CPC ..... B01L 2200/0605; B01L 2200/0621; B01L 2200/0684; B01L 2300/0803; B01L 2300/0883; B01L 2400/0406; B01L 2400/0409; B01L 2400/082; B01F 29/15; B01F 33/30; B04B 9/10; B04B 11/02; B04B 15/08
See application file for complete search history.

(56) References Cited

U.S. PATENT DOCUMENTS

| | | | |
|---|---|---|---|
| 6,527,432 | B2 | 3/2003 | Kellogg |
| 7,575,681 | B2 | 8/2009 | Angelescu |
| 8,221,701 | B2 | 7/2012 | Cho et al. |
| 2005/0199500 | A1 | 9/2005 | Gason et al. |
| 2008/0017634 | A1 | 1/2008 | Wiezoreck et al. |
| 2008/0110500 | A1 | 5/2008 | Kido |
| 2008/0237151 | A1 | 10/2008 | Cho |
| 2008/0317634 | A1 | 12/2008 | Kido |
| 2009/0035847 | A1 | 2/2009 | Cho |
| 2009/0053108 | A1 | 2/2009 | Cho et al. |
| 2009/0148912 | A1 | 6/2009 | Takagi |
| 2009/0209752 | A1 | 8/2009 | Peters et al. |
| 2009/0317896 | A1 | 12/2009 | Yoo |
| 2010/0021347 | A1 | 1/2010 | Garcia Da Fonseca |
| 2010/0175994 | A1 | 7/2010 | Lee |
| 2014/0109972 | A1* | 4/2014 | Garcia Da Fonseca ..... B01L 3/50273 137/561 R |
| 2014/0356129 | A1 | 12/2014 | Paust |
| 2018/0280969 | A1 | 10/2018 | Tenreiro et al. |

FOREIGN PATENT DOCUMENTS

| | | | |
|---|---|---|---|
| DE | 102013203293 | A1 | 8/2014 |
| EP | 1 459 795 | A1 | 9/2004 |
| EP | 1 980 322 | A1 | 10/2008 |
| EP | 2 817 519 | A1 | 12/2014 |
| JP | 2001503854 | A | 3/2001 |
| KR | 20080022035 | A | 3/2008 |
| KR | 20100083029 | A | 7/2010 |
| WO | WO 98/07019 | | 2/1998 |
| WO | WO 2007/042208 | A1 | 4/2007 |
| WO | WO 2010/047609 | A1 | 4/2010 |
| WO | WO 2013/124258 | A1 | 8/2013 |
| WO | WO 2017/0103029 | A1 | 6/2017 |

OTHER PUBLICATIONS

Gorkin III et al., "Pneumatic pumping in centrifugal microfluidic platforms," Feb. 17, 2010, 9 pages.
Kamell, "Thermo-pneumatic pumping in centrifugal microfluidic platforms," Springer Verlag 2011, 2011.
Zehnle et al., "Microfluidic Centrifugo-Pneumatic Siphon Enables Fast Blood Plasma Extraction with High Yield and Purity," 16$^{th}$ International Conference on Minaturized Systems for Chemistry and Life Sciences, Oct. 28-Nov. 1, 2012, Okinawa, Japan, 3 pages.
Office Action dated Sep. 6, 2018, for EP Application No. 12716631.2, 5 pages.
Portugal Search Report for PTA 2016109660, dated Oct. 3, 2017, 4 pages.
Search Report and Written Opinion dated May 12, 2017 for PCT Application No. PCT/EP2016/081320, 26 pages.
Search Report dated May 27, 2011 for Portuguese Application No. 105589, 6 pages.
Search Report dated Nov. 7, 2016 for Portuguese Application No. 109453, 6 pages.
International Search report and Written Opinion for International Application No. PCT/EP2017/064138, dated Oct. 23, 2017.
Application and File History for U.S. Appl. No. 14/007,812, filed Sep. 26, 2013, inventor(s) Tânia Tenreiro et al.
Application and File History for U.S. Appl. No. 15/532,083, filed Dec. 15, 2016, inventor(s) Tânia Tenreiro et al.
Application and File History for U.S. Appl. No. 15/618,436, filed May 9, 2017, inventor(s) Nuno Alexandre E. Reis et al.

* cited by examiner

LIQUID FLOW CONTROL

RELATED APPLICATIONS

The present application is a divisional of U.S. Patent Ser. No. 15/618,436, filed Jun. 9, 2017, which claims priority to Great Britain Application No. 1610102.4 filed Jun. 9, 2016, Portuguese Application No. 109453 filed Jun. 9, 2016, Great Britain Application No. 1617083.9 filed Oct. 7, 2016, and Portuguese Application No. 109662 filed Oct. 7, 2016, each of which is hereby incorporated herein in its entirety by reference.

FIELD OF THE DISCLOSURE

The present disclosure relates to a liquid handling device having an axis of rotation about which the device can be rotated to drive flow of liquid in the device and a liquid flow control unit for controlling liquid flow between an upstream and a downstream chamber. The present disclosure further relates to a system for driving liquid flows in such a device and a method of driving liquid flows.

BACKGROUND OF THE DISCLOSURE

Devices which can be rotated about an axis of rotation to drive liquid flows within the device are known as centrifugal liquid handling devices. Typically, it is necessary to control liquid flows in such devices in a way that allows flows to be started and stopped differentially in different parts of the device. In other words, often such devices require a liquid flow control unit (also referred to as a "valve") to control the flow of liquid, in particular to start liquid flow out of an upstream chamber at a desired point in time. Arrangements for valves in centrifugal liquid handling devices include sacrificial valves, capillary valves and capillary siphon valves.

Sacrificial valves have the drawback of requiring some sort of interaction with the device from outside in order to open ("sacrifice") the valve. While capillary valves and capillary siphon valves can be "opened" by controlling the speed of rotation of the device, they rely on surface tension effects to, respectively, retain liquid behind a surface tension barrier or draw liquid into a siphon conduit by capillary action. These valves therefore require careful choice of the material of the device in the region of the valve. What is more, they require a limited specific speed range for the device in order to operate the valve. Specifically, a capillary valve can remain "closed" only below a certain speed of rotation at which the surface tension barrier is overcome, and capillary siphon valves require the device to be slowed down sufficiently so that the capillary force can draw liquid into the siphon conduit.

SUMMARY OF THE DISCLOSURE

Any reference to a fill level of a liquid containing structure (e.g. a chamber or conduit) rising will be understood to refer to the liquid level moving radially inwards, towards the axis of rotation. Similarly, any reference to a fill level of a liquid containing structure (e.g. a chamber or conduit) falling will be understood to refer to the liquid level moving radially outwards, away from the axis of rotation.

It will be understood that any reference to a structure 'A' being disposed radially inwards of a structure 'B' should be taken to mean that a distance between structure 'A' and the axis of rotation of the device is less than a distance between structure 'B' and the axis of rotation of the device.

Equally, it will be understood that, reference to a structure 'A' being disposed radially outwards of a structure 'B' should be taken to mean that a distance between structure 'A' and the axis of rotation of the device is greater than a distance between structure 'B' and the axis of rotation of the device.

It will be understood that any reference to a structure extending radially inwards should be taken to mean that the structure extends towards the axis of rotation. Equally, it will be understood that any reference to a structure extending radially outwards should be taken to mean that the structure extends away from the axis of rotation.

In a first aspect of the disclosure, a liquid handling device has an axis of rotation about which the device can be rotated to drive liquid flow in the device. The device comprises a vented upstream chamber comprising an outlet port and an unvented chamber comprising an inlet port to receive liquid from the outlet port of the upstream chamber and comprising an outlet port radially outward of the inlet port. The device further comprises a vented downstream chamber comprising an inlet port to receive liquid from the outlet port of the unvented chamber. A downstream conduit connects the outlet port of the unvented chamber to the inlet port of the downstream chamber and comprises a bend radially inward of the outlet port of the unvented chamber. An upstream conduit connecting the outlet port of the upstream chamber to the inlet port of the unvented chamber comprises a portion radially outward of the inlet port of the unvented chamber.

As liquid flows into the unvented chamber, air is trapped radially inward of the liquid level in the unvented chamber as soon as the outlet port of the unvented chamber is filled with liquid and as liquid continues to flow into the unvented chamber, the gas pressure in the unvented chamber rises with the liquid level in the unvented chamber until the gas pressure is balanced by the centrifugal pressure at the inlet port of the unvented chamber (with the liquid column in the downstream conduit rising accordingly to balance the pressure at the outlet port). When the device is then slowed, the centrifugal pressure is decreased and liquid is driven through the inlet and outlet ports of the unvented chamber by the gas pressure in the chamber. If sufficient gas pressure has been built up, this will then push the liquid column in the downstream conduit past the bend and radially out of the liquid level in the unvented chamber, at which point any centrifugal force will cause emptying of the unvented chamber through the outlet port as a result of a siphon effect, drawing liquid through the inlet port of the unvented chamber and hence from the upstream chamber. By configuring the upstream conduit connecting the upstream and unvented chambers with a bend radially outward of the inlet port of the unvented chamber, the liquid column in the upstream conduit is increased by the displacement of liquid with gas as the device is slowed, thereby preventing gas escaping upstream. For the avoidance of doubt, a liquid column in a conduit or other structure will be understood to refer to the net radial extent of liquid in the conduit or structure and, more generally, a liquid column associated with a volume of liquid at a radial position within the volume can be seen as the net radial extent of the volume radially inwards of the radial position.

It will, of course, be understood that the outlet port of the upstream chamber is radially inward of the inlet port of unvented chamber and radially inward of the inlet port of downstream chamber, in order to ensure liquid flows can be centrifugally driven from the upstream chamber to the downstream chamber. Likewise, it will be understood that the terms "vented" and "unvented" are used such that a vented chamber is connected to the atmosphere external to the device or a closed air circuit so that pressure can equilibrate as liquid flows in or out of respective inlet and outlet ports of the vented chamber. Conversely, an unvented chamber is neither connected to external air nor to a closed air circuit such that, once liquid fills the inlet and outlet ports of the unvented chamber any difference in respective flow rates in and out of the unvented chamber leads to a change in pressure in the unvented chamber. In other words, in an unvented chamber the only fluid flow paths in or out of the unvented chamber are through one or more liquid ports part of a liquid flow circuit of the device.

For example, in some embodiments, the upstream conduit comprises an inverted siphon conduit, the inverted siphon conduit comprising a bend radially outward the inlet of the unvented chamber. The inverted siphon conduit may connect the outlet port of the upstream chamber to the inlet port of the unvented chamber, that is extended from one to the other.

In a second aspect of the disclosure, a liquid handling device has an axis of rotation about which the device can be rotated to drive liquid flow in the device. The device comprises a vented upstream chamber comprising an outlet port and an unvented chamber comprising an inlet port to receive liquid from the outlet port of the upstream chamber and comprising an outlet port radially outward of the inlet port. The device further comprises a vented downstream chamber comprising an inlet port to receive liquid from the outlet port of the unvented chamber. A downstream conduit connects the outlet port of the unvented chamber to the inlet port of the downstream chamber and comprises a bend radially inward of the outlet port of the unvented chamber. The vented upstream chamber, unvented chamber, upstream conduit and downstream conduit are configured such that, in operation a level of liquid in the unvented chamber is maintained radially outward of the inlet of the unvented chamber at least until liquid moves past the bend of the downstream conduit. To facilitate the generation of sufficient gas pressure to achieve this, a volume of the unvented chamber radially between the inlet and outlet ports of the unvented chamber may in some embodiments exceeds one fifth, preferably one third or even one half of the volume of the unvented chamber radially inwards of the outlet. In some embodiments, the unvented chamber comprises a liquid retaining portion and the device is configured to at least partially fill the liquid retaining portion. The volume of the liquid containing portion of the unvented chamber radially between the inlet and outlet ports of the unvented chamber may exceed one fifth, preferably one third, of the volume of the unvented chamber.

By maintaining the level of liquid in the unvented chamber radially outward the inlet port of the unvented chamber, the two liquid columns balancing the gas pressure inside the unvented chamber are off-set relative to each other so that the upstream liquid column generating the gas pressure in the liquid can be balanced by a radially offset downstream column in the downstream conduit. This means that the bend in the downstream conduit can be placed radially further outward than would otherwise be possible to be able to retain liquid in the downstream conduit before it is pushed past the bend. In particular, this makes it possible to position the bend radially outward a liquid level in the vented upstream chamber, thereby enabling designs that are radially more compact than comparable capillary siphon designs.

It will be understood that, in some embodiments, the first and second aspects are combined in the same embodiments. Further, the following features of certain embodiments are equally applicable to both aspects.

In some embodiments, the vented upstream chamber, unvented chamber, upstream conduit and downstream conduit are configured such that the level of liquid in the unvented chamber is maintained radially inward of the outlet of the unvented chamber subsequent to liquid flowing past the bend of the downstream conduit as long as liquid is flowing through the inlet of the unvented chamber. In this way, the siphon effect is maintained while there is liquid flow from the upstream chamber, allowing the upstream chamber to empty completely. In other embodiments, it is preferable that the liquid column in the downstream conduit is broken, stopping liquid flow from the upstream chamber and thus resetting flow control.

In some embodiments, the unvented chamber, upstream conduit and downstream conduit are configured such that, in operation, a level of liquid in the vented upstream chamber is maintained prior to liquid flowing past the bend of the downstream conduit. By retaining liquid in the upstream chamber, the liquid column at the inlet port of the unvented chamber is maintained. This enables space savings in terms of the radial extent of the arrangement and also the size of the unvented chamber. For example, the unvented chamber may have a volume (or be configured to fill to a volume) that is less than the volume of liquid in the upstream chamber when the upstream chamber is filled to its fill level (as defined by, for example, an overflow feature in the upstream chamber or other aliquoting feature, or by a defined amount of liquid received from an upstream structure or from outside the device, for example by way of a specific measuring implement or instruction).

It will be understood that, given the radial geometry of the device and the centrifugally driven flow, the term "level" is understood to be the radially inward face of a liquid volume or column and will be shaped by a combination surface tension effects and centrifugal forces, i.e. will typically not be a geometrically flat interface between liquid and gas. Reference to "operation" above means operation under normal operating conditions and in particular operation at maximum or design rotation speeds applied in realistic embodiments when liquid is present in the unvented chamber, for example when the device is rotated at a speed of up to or of 1000, 2000, 3000, 4000, 5000, 6000, 7000, 8000, 9000 or 10000 revolutions per minute. Specifically, in some embodiments, the maximum fill level of the unvented chamber described above is maintained at speeds up to or of 7000 revolutions per minute.

In some embodiments, the downstream conduit and upstream conduit are configured to limit a flow rate through the outlet port of the unvented chamber to less than a flow rate through the inlet port of the unvented chamber. This facilitates the maintenance of a liquid level in the unvented chamber. For example, in some embodiments, a hydraulic resistance of the upstream conduit does not exceed a hydraulic resistance of the downstream conduit.

In some embodiments, the volume in the unvented chamber radially between the inlet and outlet ports of the unvented chamber exceeds one fifth, preferably one third, of the volume of the unvented chamber. Similarly, in particular where liquid is, at least initially, constrained to fill only some of the circumferential extent of the unvented chamber between the inlet and outlet ports, the volume in a liquid containing portion of the unvented chamber radially between the inlet and outlet ports of the unvented chamber may exceed one fifth, preferably one third, of the volume of the unvented chamber.

In some embodiments, the unvented chamber extends radially outward of the outlet port of the unvented chamber to trap a sediment in the unvented chamber, defining a volume that retains liquid and/or sediment inside the unvented chamber. Advantageously this enables liquid flow control with phase separation in a single structure. In some embodiments, the upstream conduit extends radially outward to a bend and radially inward from the bend and the liquid handling device comprises a sediment chamber connected to the bend to trap sediment in the upstream conduit. Advantageously, this enables sedimentation upstream of the unvented chamber without clogging and further enables liquid flowing into the unvented chamber, once flow is enabled, to be at least rich in the lighter phase. For example, the sediment chamber may be formed by a radially outer wall of the upstream conduit expanding radially outward in the region of the bend. In some embodiments, a portion of the unvented chamber extends radially outward of the outlet port of the unvented chamber in a direction forming an acute angle with a radius through the unvented chamber. Advantageously, by appropriately selecting the angle and dimensions of the unvented chamber it is possible increase sedimentation efficiency, reducing the time required to separate the denser from lighter phase or phases.

In some embodiments, the liquid handling device comprises a plurality of liquid flow control units, each unit comprising a respective vented upstream chamber, unvented chamber, upstream conduit and downstream conduit as described above. Each unit is configured to prime the downstream conduit (i.e. cause liquid to advance in the downstream conduit to a point where the centrifugal force drives liquid flow to the inlet of the downstream vented chamber) at a different speed of rotation. In this way, liquid flow can be controlled in a sequence of respective liquid flows through the downstream conduit of each unit (and hence out of each unvented upstream chamber) by controlling the speed of rotation.

It will be understood that in some embodiments there may be more than one plurality/set of liquid flow control units and that some of the total set of liquid flow control units may prime at the same speed. In some embodiments, the vented downstream chamber may be shared between some or all of the units (for example there may be a single vented downstream structure fed by all downstream conduits, directly or via a manifold), or the device may have one vented downstream chamber per unit.

In some embodiments, the device is a microfluidic device, specifically a microfluidic centrifugal device. The term microfluidic is used herein to designate devices or liquid handling structures having a smallest dimension, for example depth or width, of less than 1*mm*, for example of the order of micrometers, tens of micrometers or hundreds of micrometers.

In some embodiments, the device comprises one or more reagents disposed within the unvented chamber, radially outwards of the inlet port of the unvented chamber. The one or more reagents may be in a dry or gel state or embedded in a support material (e.g. membrane). Examples of such reagents are antibodies, enzymes, enzyme substrate, conjugated particles, latex beads, nanoparticles, anticoagulants, buffers, lysing agents, stains, dyes, etc. In some embodiments, the device comprises one or more reagents disposed within the unvented chamber, radially inwards of the outlet port of the unvented chamber.

When liquid comes into contact with the one or more reagents in the unvented chamber, the reagents are suspended in the liquid. It may be desirable to mix the liquid with reagents in advance of further processing steps, which may occur in the downstream chamber, for example, or in liquid handling structures downstream of the downstream chamber.

In some embodiments, whether configured in a disc-shape or otherwise, the device is manufactured by forming the liquid handling structures (channels, conduits, etc.) in a substrate, for example by injection moulding or stamping the substrate. The substrate is then sealed by bonding a polymer film to the surface in which the liquid handling structures are defined, with appropriate cut-outs for fluidic access to the liquid handling device. In other embodiments, the device may be formed by bonding together two substrates, which may both define respective liquid handling structures, for example, in cooperation, or by a sandwich of a bonding film between two substrates. This will be described in more detail below, with reference to the Figures.

In embodiments, in which one or more dry reagents are disposed in the unvented chamber, the one or more dry reagents may be applied to the device by first applying drops of solution containing the reagent(s) to the relevant substrate, in the region which, once the substrate is bonded with its counterpart (either the polymer film or another substrate), will form the unvented chamber. The drops of solution are then allowed to dry, thus leaving behind the dry reagent(s) on the substrate.

Alternatively, a solution containing the one or more reagents may be applied to a body of absorbent material, which is then allowed to dry, leaving behind dry reagent(s) on the material. The material can then be inserted into the substrate, in the region which will form the unvented chamber prior to or after the substrate has been bonded with its counterpart.

In some embodiments, the unvented chamber comprises a first portion and a second portion. A radially-outer wall of the unvented chamber extends radially inwards to a bend and radially outwards from the bend, thus separating the first portion from the second portion. The outlet port is disposed in the first portion. The inlet port of the unvented chamber may be disposed adjacent to the first portion such that, on entering the unvented chamber via the inlet port, liquid enters the first portion and begins to fill the first portion.

In some embodiments, the volume of the first portion of the unvented chamber may exceed one fifth, preferably one third, of the volume of the unvented chamber.

An advantage of the first and second portions, as described above, is that as liquid enters the unvented chamber (in particular the first portion), a fill level of liquid in the unvented chamber (in the first portion), rises faster and also reaches further radially inwards than it would otherwise do if the unvented chamber had the same circumferential and radial extents but was not separated into the first and second portions (i.e. if liquid was not constrained, at least initially, to fill only some of the circumferential extent of the unvented chamber). This may be beneficial by facilitating liquid coming into contact with all of the one or more reagents disposed in the unvented chamber. Another option (instead of providing an unvented chamber with first and second portions, as described) would be to make the unvented chamber narrow, i.e. with a small circumferential extent and a relatively large radial extent. However, this second option would take up more radial space, which may be limited, for example if the device is a disk. It will be appreciated that liquid may or may not enter the second portion.

The above-described structure (the radially-outer wall of the unvented chamber extending radially inwards to a bend and radially outwards from the bend) may be used to meter a well-defined volume of liquid. In some embodiments, the first portion is a metering portion, the second portion is an overflow portion and the bend in the wall is radially outwards of the inlet port of the unvented chamber. This structure may be described as an overflow structure.

As liquid flows into the unvented chamber and the unvented chamber (in particular, the metering portion) fills with liquid, a fill level in the metering portion rises (i.e. moves radially inwards). Once the fill level reaches the radial position of the bend in the radially-outer wall of the chamber, liquid overflows from the metering portion into the overflow portion and a well-defined volume of liquid is held in the metering portion. As long as the volume of liquid present in the unvented chamber at any one time does not exceed the combined volume of the metering and overflow portions, a well-defined volume of liquid (in the metering portion) can be separated from the liquid in the overflow portion. This may be desirable in applications where a liquid with a specific mixing ratio, of liquid to reagent or dilutant, for example, (and hence a specific volume of liquid) is required.

In some embodiments, one or more reagents, for example dry reagents, may be disposed in the first portion of the unvented chamber.

The unvented chamber may be configured to promote mixing of the liquid, for example mixing of the liquid with dry reagents. In some embodiments, a first portion of a radially-outer wall of the unvented chamber slopes away from the outlet port, radially inwards in a first circumferential direction to connect to a first side wall of the unvented chamber and a second portion of the radially-outer wall of the unvented chamber slopes away from the outlet port, radially inwards in a second circumferential direction, opposed to the first circumferential direction, to connect to a second side wall of the unvented chamber. In this way, the radially-outer wall of the unvented chamber may form a 'V' shape, with the outlet port of the unvented chamber at the vertex of the 'V'. This structure may facilitate an improved uniformity of the liquid. For example, in embodiments where the liquid has been mixed with one or more dry reagents, this 'V' shaped structure may improve the uniformity of the distribution of the reagents throughout the liquid. This structure may also be advantageous in embodiments where no reagents are present in the unvented chamber, however. For example, "V" or "U" outlets connecting to the outlet conduits may facilitate and improve emptying of liquid contained in the unvented chamber, which is particularly beneficial when there is a need to confine or meter very small volumes of liquid (microliter and below). Such arrangements may also facilitate the exit of reagents (for example sedimented against the outer wall or even higher viscosity liquids (for example lysed blood) trapped through the outlet. The associated small inclination at the outlets may be favourable in comparison to a equiradial outer wall where parts of liquid or reagent may be trapped against the wall between outlets. The termination of the 'V' or 'U' shaped features does not need a side wall, in particular when there are multiple outlets.

In some embodiments, the unvented chamber comprises at least one additional port radially outwards of the inlet port and the downstream conduit connects each of the outlet port and the at least one additional outlet ports to the downstream chamber. The downstream conduit may comprise a common conduit portion which is connected at one end to the downstream chamber and at the other end, branches into a plurality of conduit portions, each of which is connected to a respective outlet port of the unvented chamber.

This structure may improve mixing of the liquid and, in embodiments where the liquid has been mixed with one or more reagents which are, for example, disposed in the unvented chamber, this structure may improve the uniformity of the distribution of the reagents throughout the liquid. By extracting liquid from the unvented chamber at a plurality of different points and combining it in a conduit, the uniformity of the resuspended reagents in the liquid is improved. Embodiments in which the unvented chamber comprises at least one additional port are not limited to one or more reagents being present in the unvented chamber, however. In embodiments in which no such reagents are present, the multiple ports of the unvented chamber may still promote uniformity of the liquid.

In some embodiments, the device comprises a feature which defines the axis of rotation and which is configured to be coupled to a rotational element to drive rotation of the device. For example, the device may be a centrifugal disc, such as a microfluidic disc. The device, disc-shaped or otherwise, may comprise a central hole which is configured to engage with a spindle of a drive system, the spindle being coupled to a motor for driving rotation of the spindle, which in turn drives rotation of the engaged device.

In a third aspect of the disclosure, a system for handling liquids with a device as described above is provided. The system comprises a motor to couple to the device to rotate the device about the axis of rotation and a controller to control the motor. The controller is configured to drive the motor at a first speed to rotate the device to fill the unvented chamber with liquid from the upstream chamber and compress gas trapped in the unvented chamber; to drive the motor at a second speed, different from the first speed or to stop the motor, to cause liquid to move past the bend of the downstream conduit; and to continue driving the motor to cause liquid to flow from the upstream to the downstream chamber. In some embodiments, the second speed is less than the first speed. In some embodiments, the second speed is greater than the first speed. Further, the controller may continue rotation at a speed the same as or different from the second speed, for example at a speed less than the first speed.

In a fourth aspect of the disclosure, there is provided a method of handling liquids with a device. The device has an axis of rotation about which the device can be rotated to drive liquid flow in the device and comprises: a vented upstream chamber comprising an outlet port; an unvented chamber comprising an inlet port to receive liquid from the outlet port of the upstream chamber and comprising an outlet port radially outward of the inlet port; an upstream conduit connecting the outlet port of the upstream chamber to the inlet port of the unvented chamber; a vented downstream chamber comprising an inlet port to receive liquid from the outlet port of the unvented chamber; and a downstream conduit connecting the outlet port of the unvented chamber to the inlet port of the downstream chamber and comprising a bend radially inward of the outlet port of the unvented chamber. The method comprises rotating the device at a first speed to fill the unvented chamber with liquid from the upstream chamber and compress gas trapped in the unvented chamber while maintaining a level of liquid in the unvented chamber radially outward of the inlet of the unvented chamber; causing liquid to move past the bend of the downstream conduit by stopping the device or rotating the device at a second speed different from the first speed and continuing to rotate the device to cause liquid to flow from the upstream to the downstream chamber. In some embodiments, the level of liquid is maintained radially outward the inlet of the unvented chamber at least until liquid moves past the bend of the downstream conduit. In some embodiments, the second speed is less than the first speed. In some embodiments, the second speed is greater than the first speed. Rotation may be continued at a speed the same as or different from the second speed, for example at speed less than the first speed.

In some embodiments, the method comprises maintaining a level of liquid radially inward of the outlet of the unvented chamber subsequent to liquid flowing past the bend of the downstream conduit while liquid is flowing through the inlet of the unvented chamber. In some embodiments, the method comprises maintaining a level of liquid in the vented upstream chamber prior to liquid flowing past the bend of the downstream conduit. In some embodiments, a flow rate through the outlet port of the unvented chamber may be arranged not to exceed a flow rate through the inlet port of the unvented chamber. In some embodiments, the device used in the method is configured as described above.

In a fifth aspect of the disclosure, a method of making a liquid handling device with multiple liquid flow control units as described above comprises designing each unit such that the downstream conduit primes at a different speed of rotation and making a device comprising the units as designed.

BRIEF DESCRIPTION OF THE FIGURES

Specific embodiments of the invention are now described to illustrate aspects of the disclosure and by way of example with reference to the accompanying drawings, in which.

DETAILED DESCRIPTION OF THE FIGURES

Figure 1:
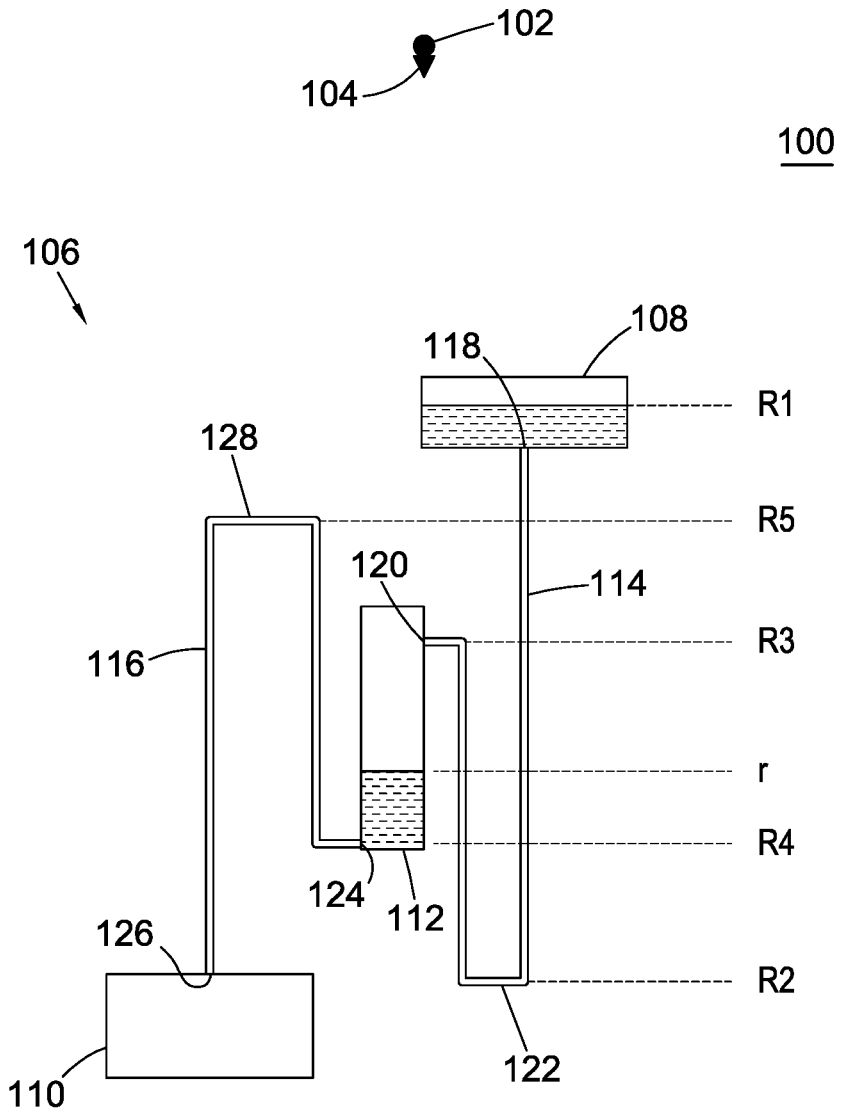
FIG. 1 illustrates a liquid handling device with a liquid flow control device.

With reference to FIG. 1, a liquid handling device 100 arranged for rotation about an axis of rotation 102 to generate centrifugal forces schematically indicated by an arrow 104 comprises a liquid flow control device 106 for controlling liquid flow between an upstream chamber 108 and a downstream chamber 110. Both the upstream chamber 108 and the downstream chamber 110 are vented, that is they are connected to atmospheric air surrounding the liquid handling device 100 or to an air circuit, for example a closed air circuit, of the device 100 to allow gas to flow between chambers 108 and 110 to equalise any pressure differential that may otherwise be caused by liquid flowing from one chamber to the other.

The liquid flow control device 106 comprises an unvented chamber 112 connected to the upstream chamber 108 by an upstream conduit 114 and to the downstream chamber 110 by a downstream conduit 116. The upstream conduit 114 extends from an outlet port 118 of the upstream chamber 108 to an inlet port 120, of the unvented chamber 112, and forms a bend 122 radially outward of the inlet port 120. The downstream conduit 116 extends from an outlet port 124 of the unvented chamber 112 to an inlet port 126 of the downstream chamber 110 and forms a bend 128 radially inward of the outlet port 124. The outlet port 118 is radially inward of the inlet port 120, the inlet port 120 is radially inward of the outlet port 124, which is radially inward of the inlet port 126. Thus, the upstream conduit 114 can be viewed as an inverted siphon conduit and the downstream conduit 116 can be viewed as a siphon conduit. It will be appreciated that the radial positioning of the inlet port 126 facilitates complete emptying of the unvented chamber 112 but that the inlet port 126 can equally be positioned further inward.

In the description that follows, it will be useful to define a number of radial positions (i.e. radial distances from the axis of rotation 102), as follows:

R1: liquid level in the upstream chamber 108;

R2: crest (radially outermost portion) of the bend 122 in the upstream conduit 114;

R3: inlet port 120 of the unvented chamber 112;

R4: outlet port 124 of the unvented chamber 112;

R5: crest (radially innermost portion) of the bend 128 of downstream conduit 116; and r: liquid level in unvented chamber 112.

Operation of the liquid flow control device 106 is now described with reference to FIG. 2A to FIG. 2F. In an initial state (FIG. 2A) the device 100 is at rest with the upstream chamber 108, filled with a defined volume of liquid. The volume of liquid may be defined by an overflow feature in the upstream chamber 108, another aliquoting feature in the upstream chamber 108, a defined volume received by a liquid handling structure further upstream or a defined liquid volume applied from outside the device to the chamber 108, for example using a corresponding liquid applicator such as a capillary tube of appropriate dimensions.

In a second state (FIG. 2B), the device 100 is rotated at a first speed to drive liquid flow out of the upstream chamber 108 through the upstream conduit 114 and into the unvented chamber 112. As liquid fills the outlet port 124 of the unvented chamber 112, the unvented chamber 112 is cut off from the air circuit or atmospheric environment in communication with the downstream chamber 110 by virtue of liquid filling the outlet port 124 and adjacent portion of the downstream conduit 116. As a result, as the liquid level rises in the unvented chamber 112 (and the portion of the downstream conduit 116, between the bend 128 and the outlet port 124), as gas pressure in the unvented chamber 112 increases.

In a third state (FIG. 2C), responsive to continued rotation, for example at the first speed, the liquid level in the unvented chamber 112, has risen to a point where the centrifugal pressure exerted by the liquid in the upstream chamber 108 and the upstream conduit 114 is balanced by the gas pressure in the unvented chamber 112, which in turn is also balanced by the centrifugal pressure exerted by the liquid column in the downstream conduit 116. The maximum centrifugal pressure that can be provided by the liquid column in the downstream conduit 116 is determined by the radial positions of the liquid level in the unvented chamber 112 and the crest of the bend 128 and is proportional to $r^2-R5^2$. Likewise, the maximum centrifugal pressure due to the liquid in the upstream chamber 108 and upstream conduit 114 is proportional to $R3^2-R1^2$. Therefore, for the liquid column in the downstream conduit 116 to be able to balance any gas pressure in the unvented chamber 112 caused by the liquid column in the upstream conduit 114 in steady-state, $r^2-R5^2 \geq R3^2-R1^2$.

As an approximation, this inequality assumes that the liquid level in the upstream chamber 108 is constant, which is of course not strictly the case as liquid flows out of the upstream chamber 108, unless the upstream chamber 108 is configured to maintain a level R1. However, in embodiments in which the tangential cross-sectional area of the upstream chamber 108 is larger than the tangential cross-sectional area of the unvented chamber 112, the decrease in the liquid level in the chamber 108 will be less than a corresponding increase in liquid level in the chamber 112, making this a reasonable approximation. In some embodiments, as required, the decrease in liquid level in the upstream chamber 108 and/or the corresponding increase in the liquid level in the downstream chamber 112, as well as a correction for the volume of liquid in the upstream conduit 114 can be added to the above calculations for design purposes.

In embodiments where steady-state balancing of pressures is desirable, the upstream chamber 108, downstream chamber 110, unvented chamber 124 and upstream and downstream conduit is 114, 116, are configured so that this inequality (or a more accurate version of it) holds in steady-state when pressures are balanced, that is the radial positions of the fill level of the upstream chamber 108, the inlet 120, the crest 128, as well as the configuration of the unvented chamber 124, are designed to satisfy this inequality for a desired operating speed of the liquid flow control device 106, at which liquid is to be held upstream of the downstream chamber 110. It will, of course, be appreciated that each such design will be suitable for a corresponding range of operating speeds. Suitable designs can be created using the approximate calculation set out above, more accurate calculations taking account of corrections for liquid level changes as mentioned above, simulations and/or trial and error prototyping. In some embodiments, the operating speed may be 1000, 2000, 3000, 4000, 5000, 6000, 7000, 8000 or 9000 revolutions per minute. Bearing in mind that the liquid flow control device 106 is a dynamic system, in some embodiments where the inequality is not met for a corresponding operating speed, the liquid flow control device 106 may still be functional to hold liquid flow for a given time, until steady-state is reached and would therefore act as a delay, rather than a stop valve.

While the liquid columns upstream and downstream of the unvented chamber 112 must, of course, balance a gas pressure inside the unvented chamber 112, and therefore have to provide the same centrifugal pressure, it can be seen that the downstream centrifugal pressure is determined by the radial distance from the crest of the bend 128 to the liquid level in the unvented chamber and the average of the respective radial positions, while the upstream centrifugal pressure is determined by the radial distance between the liquid level in the upstream chamber 108 and the inlet port 122 and the average of the respective radial positions. It can therefore be seen that, in embodiments where the fill level of the unvented chamber 112 is radially outward the inlet port 120 (as a result of appropriate design of the liquid control device 106 for a desired operating speed), the radial position of the crest of the bend 128 can be chosen radially outward of the liquid level in the upstream chamber 108 (R3>R1) without priming the downstream conduit 116 immediately. This is in contrast to a conventional siphon conduit connected directly to the outlet port 118 of the upstream chamber 108, for example a conventional capillary siphon valve. It can thus be seen that such embodiments enable liquid handling structures on a centrifugal liquid handling device to be laid out in a radially more condensed fashion, saving the radial real estate on the device.

Up to the third state described above, liquid is held upstream of the downstream chamber 110, mostly in the upstream chamber 108. In a fourth state (FIG. 2D), the speed is changed in order to prime the downstream conduit. To prime the downstream conduit 116, liquid in the downstream conduit 116 moves past the bend 128 and radially outward of the liquid level in the unvented chamber 112, so that centrifugal forces due to continued rotation of the device 100 cause liquid to be siphoned to the downstream chamber 110.

In some embodiments, the speed at which the device 100 is rotated is reduced in the fourth state relative to the speed in the third state. As the speed of the device is reduced, the centrifugal pressure exerted by the liquid columns in the upstream and downstream conduits 114, 116 is reduced in proportion with the reduction in speed. As the speed is reduced, the gas pressure in the unvented chamber 112 exceeds the new centrifugal pressure and liquid is pushed back into the upstream and downstream conduits 114, 116 by gas expanding in the unvented chamber 112 to reach a new equilibrium as the liquid level drops in the chamber 112. Initially, as the gas expands, the liquid columns in both the upstream conduit and the downstream conduit increase, as the radial position of the liquid front in the downstream conduit 116 moves radially inward towards the bend 128 and the liquid frond in the upstream conduit 114 moves radially outward towards the bend 122. At a point in time when the speed is reduced to an extent that the liquid front in the downstream conduit 116 moves past the radially innermost point of the bend 128, any further reduction in speed cannot be balanced by an increase in the liquid column in the downstream conduit 116. This is because the liquid front in the downstream conduit 116 starts moving radially outward past the bend 128.

Any further expansion of the gas in the unvented chamber 112 will further reduce the liquid column in the downstream conduit 116, as the liquid front continues to move radially outward, so that from that point onward expansion of gas in the unvented chamber 112, will drive liquid flow in the downstream conduit 116 even without a further reduction in the speed of the device.

Turning to the upstream conduit 114, as long as the expanding gas in the unvented chamber 112 does not move the liquid front in the upstream conduit past the bend 122, movement of the liquid front due to expanding gas in the unvented chamber 112 results in an increase in the liquid column, so that gas cannot escape to the upstream chamber 108. In embodiments where liquid and gas in the liquid flow control device 106 is moved between states in a quasi-steady-state manner, the inverted siphon shape of the upstream conduit prevents gas escaping upstream as long as the maximum upstream centrifugal pressure balances or exceeds the maximum downstream centrifugal pressure, i.e. $R2^2-R1^2 \geq r^2-R5^2$, again ignoring changes in R1 and r as an approximation. However, noting that the liquid flow control device 106 is a dynamic system, in particular where speeds change relatively fast, the inverted siphon shape will in any event reduce the likelihood of gas escaping upstream, since gas expanding into the upstream conduit causes an increase in the upstream liquid column.

Figure 2A:
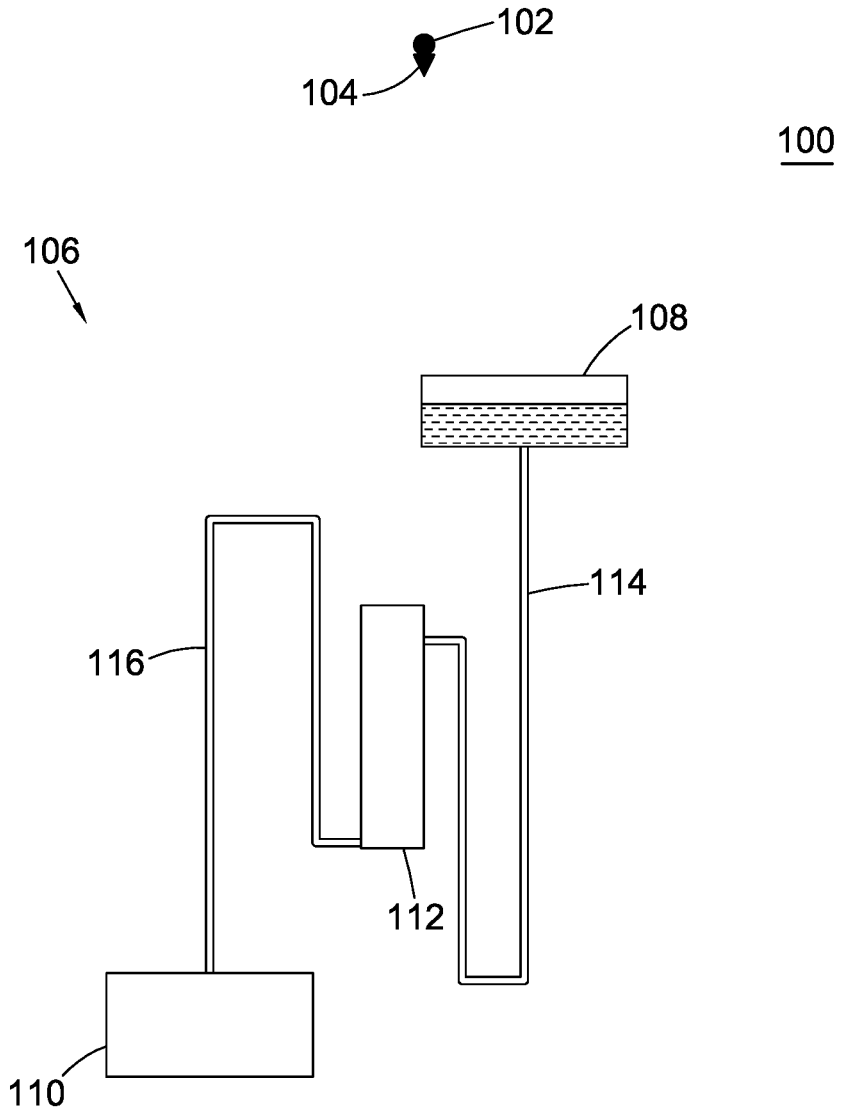
FIG. 2A illustrates operation of the liquid flow control device.
Figure 2B:
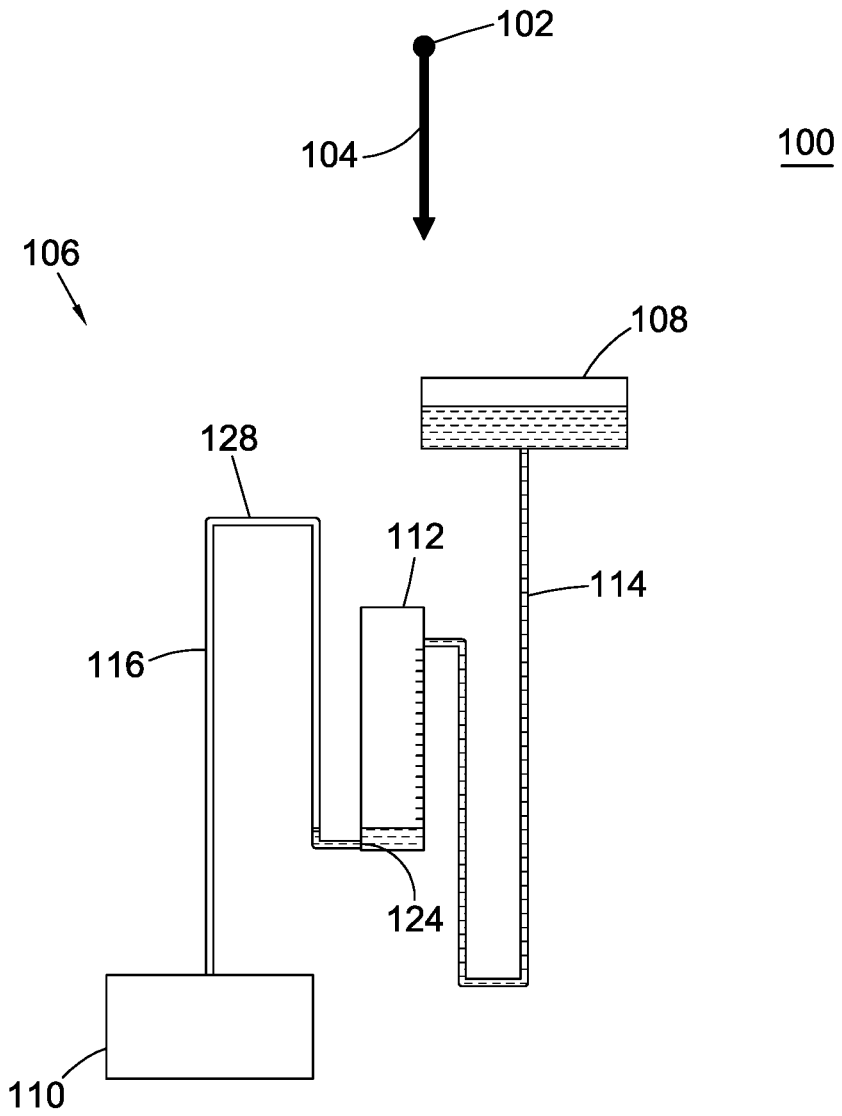
FIG. 2B illustrates operation of the liquid flow control device.
Figure 2C:
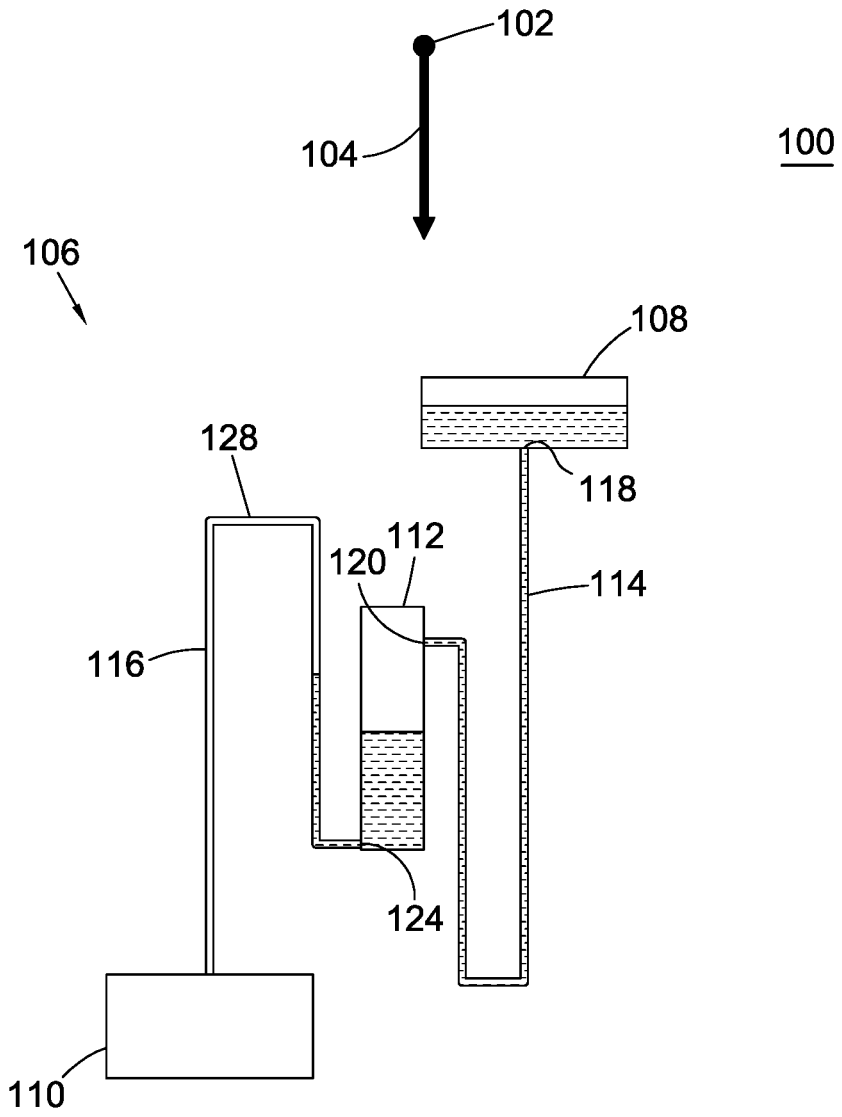
FIG. 2C illustrates operation of the liquid flow control device.
Figure 2D:
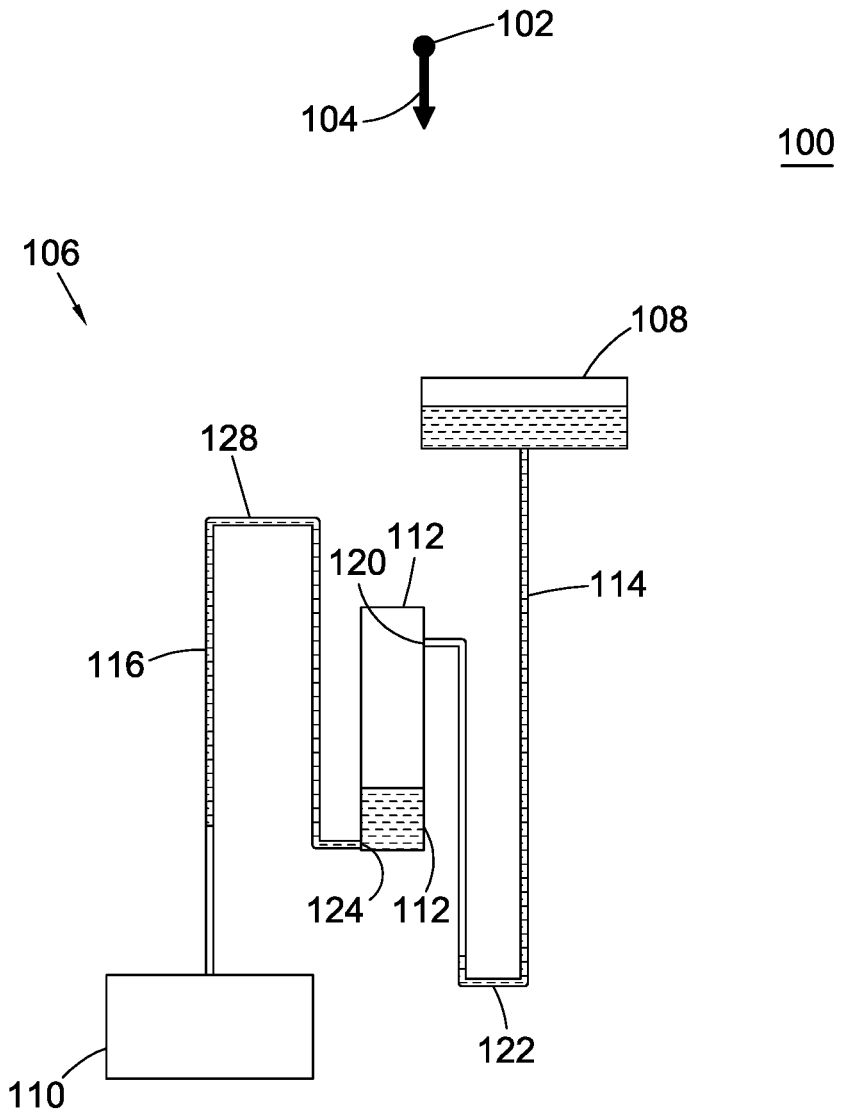
FIG. 2D illustrates operation of the liquid flow control device.
Figure 2E:
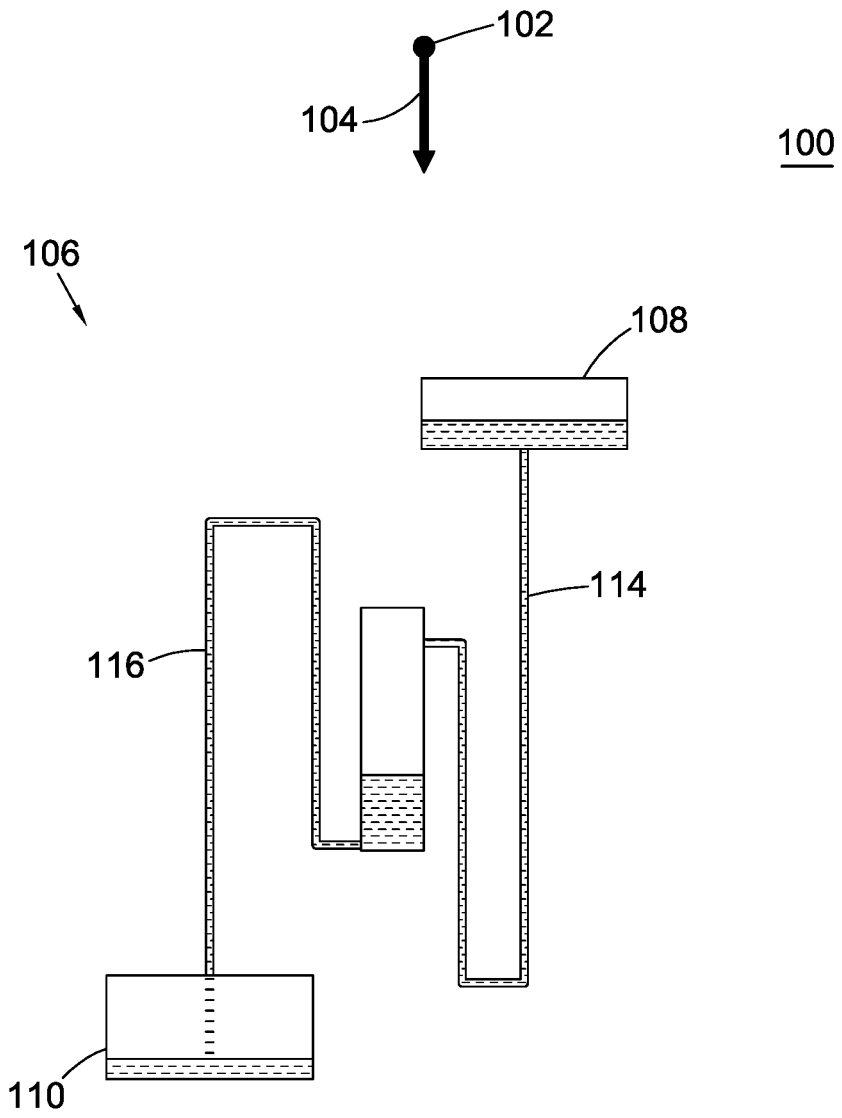
FIG. 2E illustrates operation of the liquid flow control device.
Figure 2F:
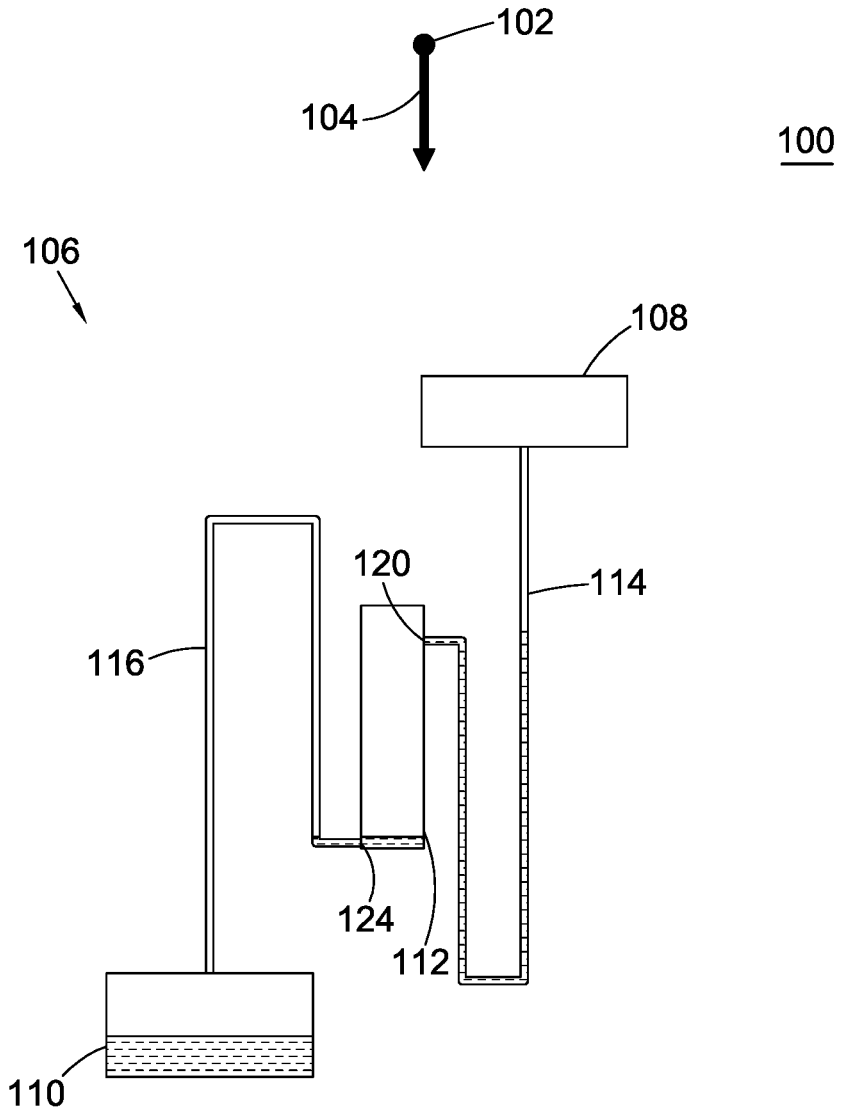
FIG. 2F illustrates operation of the liquid flow control device.

With the expansion of gas in the unvented chamber priming the downstream conduit 116, that is moving the liquid front in the downstream conduit radially outward of the liquid level in the unvented chamber, further rotation of the device 100 drives liquid flow in the conduit 116 by way of centrifugal siphoning, thereby reaching a fifth state (FIG. 2E). In the fifth state, liquid flows into the downstream chamber 110, emptying the unvented chamber 112 and reducing the gas pressure in the unvented chamber 112. At the same time, centrifugal forces continue to drive liquid flow from the upstream chamber 108 to the unvented chamber 112, filling the unvented chamber 112 and increasing the gas pressure. In dependence on the specific embodiment and application, including liquid handling functions in other parts of the device 100, the speed in the fifth state while emptying the upstream chamber 108 may be the same as, higher or lower than the speed in the fourth state (or any preceding states).

In embodiments in which complete emptying of the upstream chamber 108 is desired, the relative flow rates into and out of the unvented chamber are designed so that the unvented chamber 112 does not empty completely prior to the upstream chamber 108 emptying, by ensuring that the inflow rate is sufficiently large so that the unvented chamber 112 does not run dry before time. One way to ensure this is to make the inflow rate the same or larger than the outflow rate. To that end, in some embodiments, the hydraulic resistance of the upstream conduit 114 is smaller than the hydraulic resistance of the downstream conduit 116. In these embodiments, a sixth state (FIG. 2F) will eventually be reached in which the upstream chamber 108 has emptied and most of the liquid has been transferred to the downstream chamber 110, at which point flow ceases. Some residual liquid may remain trapped in the upstream conduit 114 radially outward the inlet port 120 and some residual liquid may be trapped in the unvented chamber 112, unless the outlet port 124 is provided in a radially outermost aspect of the unvented chamber 112. These trapped volumes can be accounted for in determining a volume flowing downstream, if required, as well as any liquid volume trapped in any portion of the downstream conduit. In some embodiments, these volumes are not trapped but are transferred to the downstream chamber 110 by suction as liquid flows from the downstream conduit 116 to the downstream chamber 110.

Figure 2G:
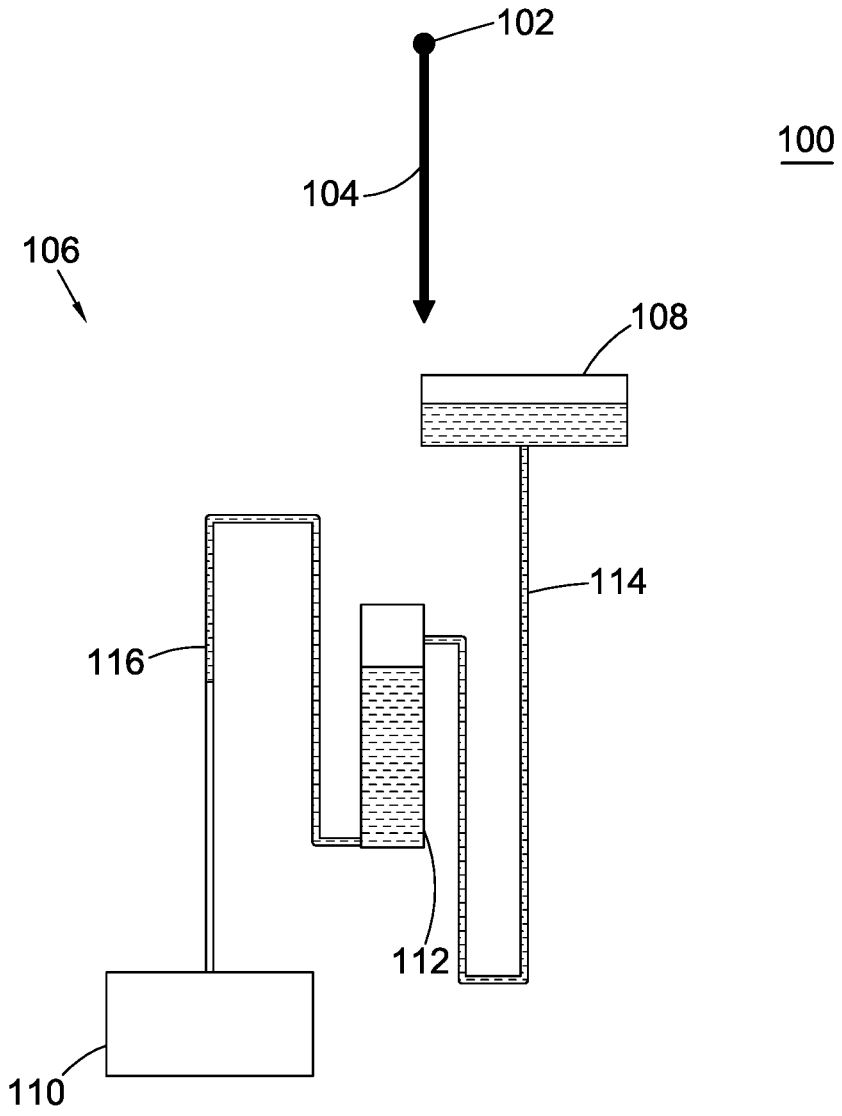
FIG. 2G illustrates operation of the liquid flow control device.

In some embodiments, as described above, the downstream conduit 116 is primed in the fourth state by reducing the speed at which the device 100 is rotated. In other embodiments, the downstream conduit is primed by increasing the speed at which the device 100 is rotated in an alternative fourth state (FIG. 2G). As the speed is increased, further liquid will flow into the unvented chamber 112 raising the liquid level further. The resulting increase in pressure further drives liquid into the downstream conduit 116, increasing the liquid column to balance the pressure. The rising level of liquid in the unvented chamber 112 reduces the downstream liquid column available to balance the gas pressure but not the upstream liquid column, which is fixed between outlet port 118 and the inlet port 120, that is between R3 and R1. Therefore, if the speed is increased sufficiently so that the gas pressure in the unvented chamber exceeds the centrifugal pressure that can be generated by the liquid column in the downstream conduit 116, the leading liquid front in the downstream conduit 116 crosses the crest of the bend 128. At this point the gas pressure will further drive the liquid front radially outward. As the liquid front crosses the radial position of the liquid level in the unvented chamber 112, further liquid flow in a downstream direction in the downstream conduit is driven by centrifugal forces and the liquid flow control device is in the fifth state (FIG. 2E), in some embodiments eventually transitioning to the sixth state (FIG. 2F) as described above. In some embodiments, the downstream conduit is primed by increasing the speed to a point at which the liquid level in the unvented chamber reaches the inlet to the unvented chamber.

Figure 3:
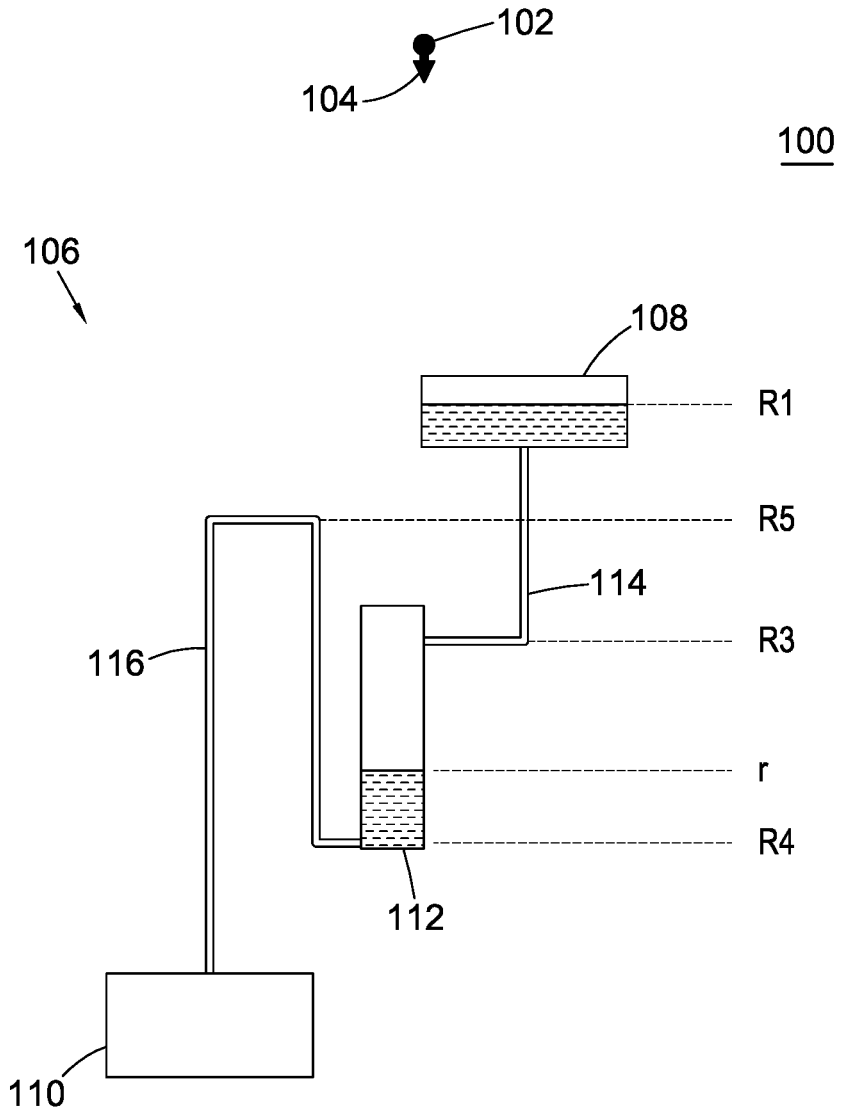
FIG. 3 illustrates a variation of the liquid flow control device.

Having read the above description of some embodiments and their operation, the skilled person will appreciated the design principles involved in the design of a liquid flow control device as described above. In particular the skilled person will appreciate that there is a large degree of design freedom in the interplay of the radial positions R1, R2, R3, and r. It will be appreciated that r depends both on the design of the unvented chamber, which may have a varying cross-section, for example radially varying depth or width, and on the operating speed at which the device is to be operated. Further design freedom arises in settings in which speeds are changed sufficiently fast so that dynamic effects become significant. For example, the escape of gas upstream needs only be prevented or reduced for the time it takes for the downstream conduit to prime, relaxing the requirements on the radial position R2 of the bend 122 in a dynamic setting. Additionally, in particular in embodiments in which the downstream conduit 116 is primed by an increase in pressure and in which the speed need not be reduced prior to emptying the upstream chamber 108, as described above with reference to FIG. 2G, the liquid flow control device 106 can be designed without a u-shaped bend 122 in the upstream conduit 114. For example, in some embodiments, the upstream conduit 114 may be configured with an elbow bend as illustrated in FIG. 3.

Figure 4A:
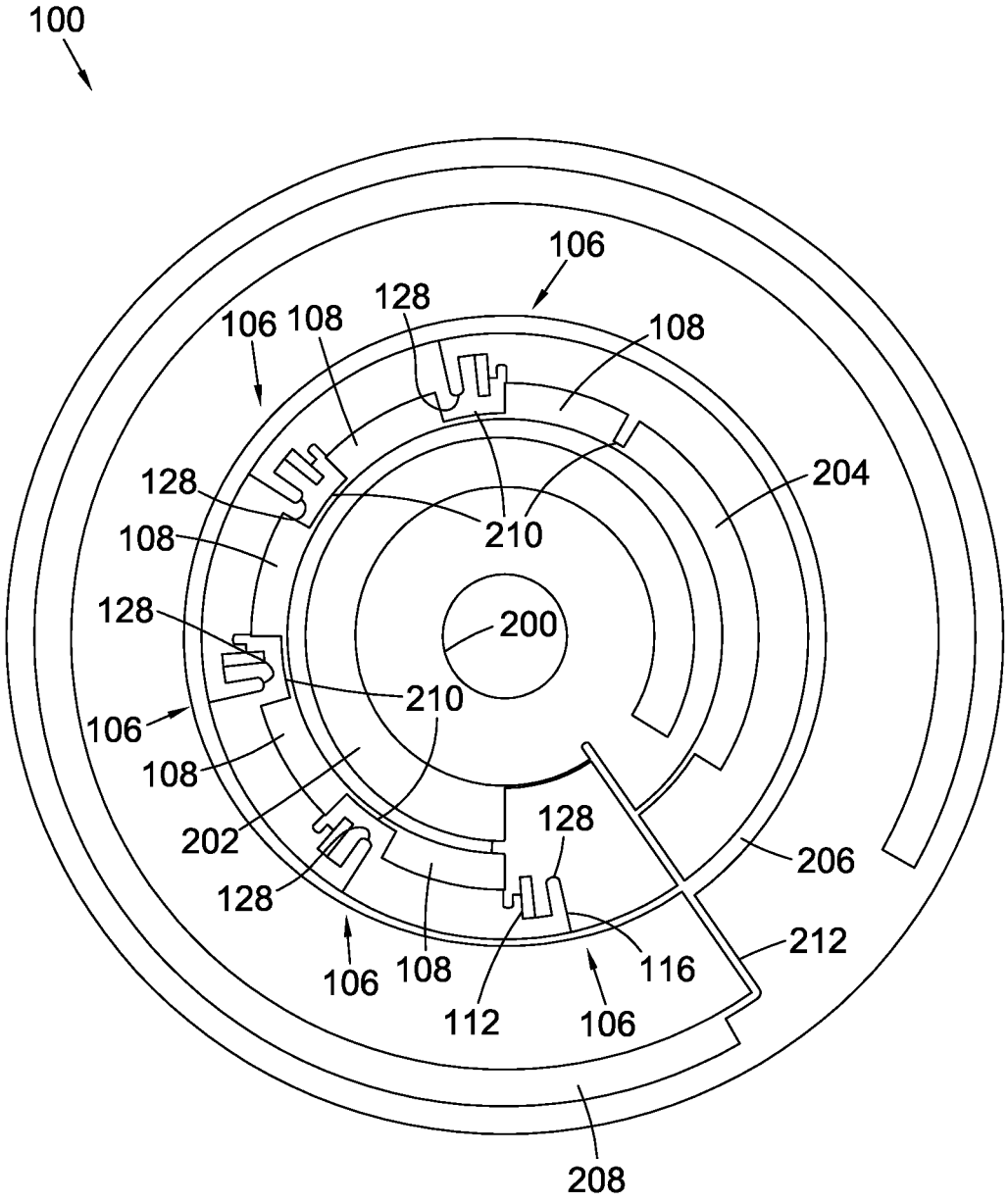
FIG. 4A illustrates a device with a plurality of liquid flow control devices to sequence liquid flows.
Figure 4B:
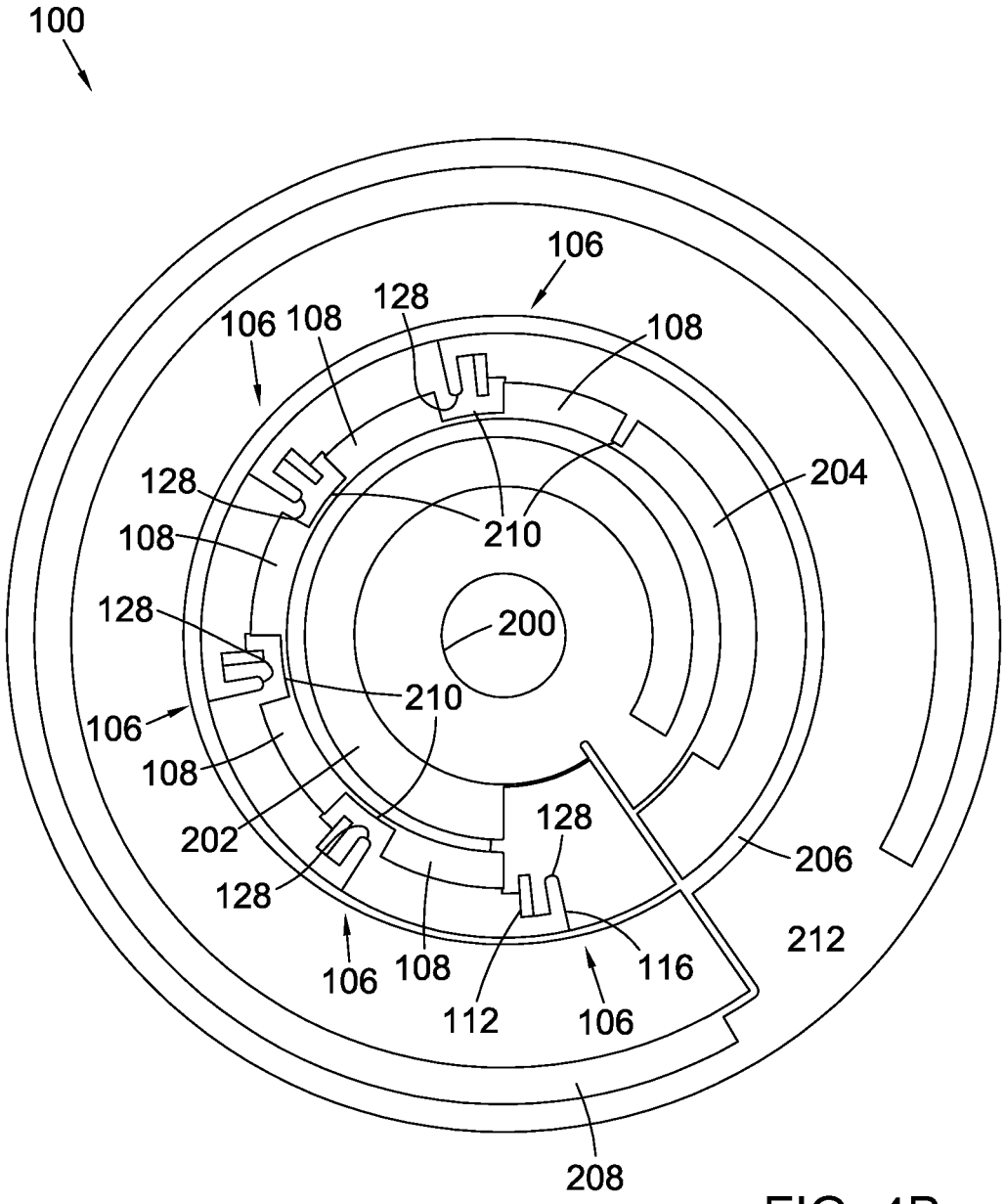
FIG. 4B illustrates a device with a plurality of liquid flow control devices to sequence liquid flows.
Figure 4C:
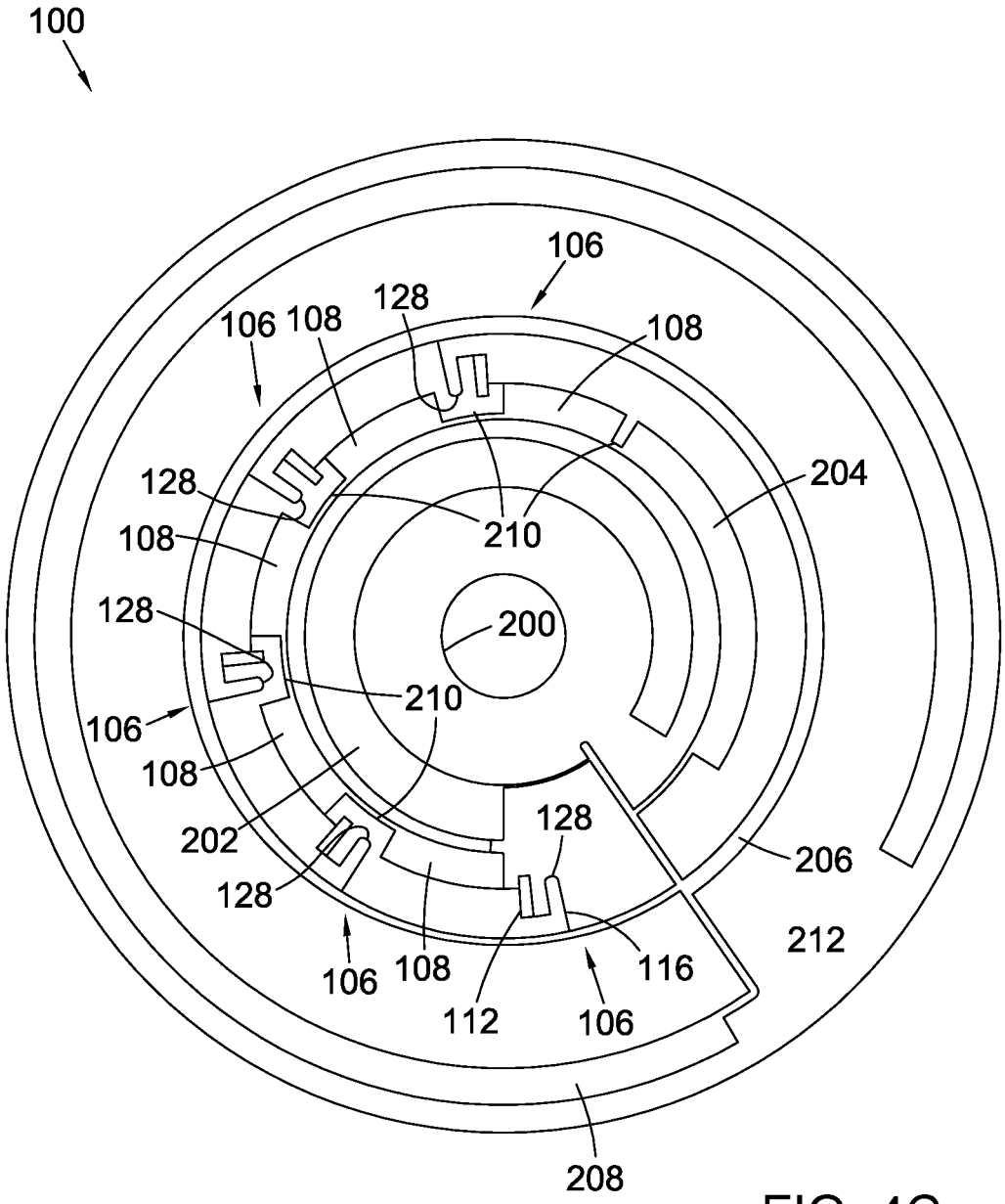
FIG. 4C illustrates a device with a plurality of liquid flow control devices to sequence liquid flows.

With reference to FIG. 4A, FIG. 4B and FIG. 4C, some embodiments combine a plurality of liquid flow control devices 106 in a single device 100. In some embodiments, the device 100 is configured as a disc-shape with a central locating feature 200 to engage with a spindle of a drive system for rotating the device 100. It will be appreciated that this configuration is applicable not only to devices with a plurality of liquid flow control devices 106, but also to devices with only a single such device. The device 100 comprises a liquid reservoir 202 connected to a first upstream chamber 108 to supply liquid to the first upstream chamber. The upstream chamber 108 is connected by an overflow conduit 210 to a further upstream chamber 108, which is connected by another overflow conduit 210 to another overflow chamber 108 and so forth. A final upstream chamber 108 is connected by a final overflow conduit 210 to a waste chamber 204. The upstream chambers 108 and overflow conduits 210 are provided at a same respective radial position, in some embodiments.

Each upstream chamber 108 is connected to a respective liquid flow control device 106, and it can be noted that the bend 128 of the downstream conduit 116 of the respective flow control device 106 is radially outward of the overflow conduit 210, and therefore readily outward of the fill level of the upstream chamber's 108. This enables each liquid flow control device 106 to be partially disposed between adjacent upstream chambers 108, in particular with the unvented chamber 112 and outlet conduit 116 partially protruding into a space between adjacent upstream chambers 108. In this way, a structure is provided with a compact radial extent.

The outlet conduit 116, of each liquid control device 106 is connected to an outlet manifold 206, which in turn is connected by a gas and liquid exchange manifold 212 to a liquid receiving chamber 208. It can be seen that, in these embodiments, the downstream chamber 110 is provided in the form of a liquid receiving manifold connected by another manifold to a liquid receiving chamber. The liquid exchange manifold 212, enables gas to escape from the waste chamber 204, the manifold 206 and liquid receiving chamber 208 to the reservoir 202 as liquid flows in the device, as well as acting as a conduit between the liquid receiving manifold 206 and liquid receiving chamber 208. For example, the liquid exchange manifold 212 may have a cross-section dimensioned so that it is not filled completely by liquid, so that liquid can flow radially outwards while gas escapes inward. Other means of venting are of course equally possible.

In some embodiments, the liquid flow control devices are configured in accordance with embodiments described above with reference to FIG. 1, FIG. 2A to FIG. 2G, as depicted in FIG. 4A, with an upstream conduit configured as an inverted siphon. In some embodiments, the liquid flow control devices are configured in accordance with embodiments described above with reference to FIG. 3, as depicted in FIG. 4B, with an upstream conduit configured with an elbow. In some embodiments, the liquid flow control devices are configured in accordance with yet further embodiments, with an upstream conduit that is neither an inverted siphon, nor an elbow configuration but, for example, with a straight length of conduit. In some embodiments, the straight length of conduit extends radially outward from the outlet port 118 of the upstream chamber 108. In some embodiments (not shown), the upstream conduit follows a radial contour from the outlet port 118 of the upstream chamber 108 and in some embodiments, the upstream conduit spirals radially outward from the outlet port 118 to the inlet port 120, of the unvented chamber 112.

Based on the principles described above, the liquid flow control devices 106 are designed such that the respective outlet conduits prime at different respective speeds of rotation. In this way, by controlling the speed of rotation, the timing of liquid dispensing from the upstream chambers 108 in a sequence defined by the design of the liquid flow control devices 106 can be controlled. For example, the liquid flow control devices can be designed such that the outlet conduit 116 of each liquid flow control device 106 primes at a different respective rotational speed, or subsets of outlet conduits 116 may be designed to prime in respective groups. Of course, in some embodiments, the liquid flow control devices 106 may be configured so as to all prime at the same rotational speed. Design parameters that can be adjusted to influence the priming behaviour include the volume of the unvented chamber 112 (which is negatively correlated with pressure and hence the liquid level in the unvented chamber 112 for a given speed of rotation), the radial position R3 of the inlet port 120, of the unvented chamber 112 (positively correlated with the centrifugal pressure at a given speed of rotation) and the radial position R5 of the crest of the bend 128 of the outlet conduit 116 (negatively corrected with the centrifugal pressure generated by the liquid column in the downstream conduit 116 at a given speed of rotation).

In operation, as the device is rotated, liquid provided in reservoir 202 flows into the first upstream chamber 108 and from there, via the overflow conduits 210, to subsequent upstream chambers 108, with any excess liquid flowing into the waste chamber 204. As a result, well-defined aliquots of liquid are provided in each upstream chamber 108. The device is rotated at a speed such that all unvented chambers 112 fill to a level at which the gas pressure in the unvented chambers 112 is balanced by the respective centrifugal pressure exerted by the liquid in the upstream and downstream conduits 114, 116, as described above. Then, at a point in time, at which liquid is to be dispensed from one more identified ones of the upstream chambers 108, the speed is changed to prime the corresponding one or more outlet conduits 116 and empty the corresponding one or more upstream chambers is to the liquid receiving manifold 206. The speed is then changed again to prime one or more of the remaining outlet conduits 116 in order to dispense liquid from the corresponding one or more upstream chambers 108 and so forth.

Figure 5:
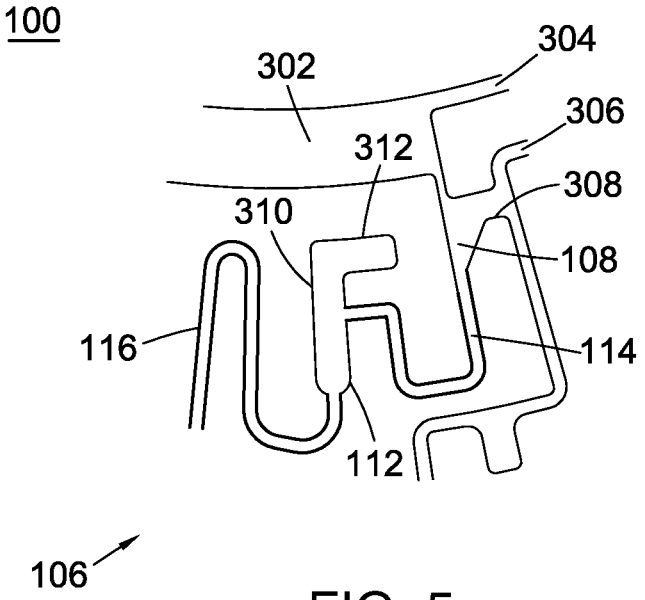
FIG. 5 illustrates a specific configuration of a liquid flow control device.

With reference to FIG. 5, in some specific embodiments, a liquid reservoir 302 is connected to the upstream chamber 108 to fill the upstream chamber 108 with liquid. Vent connections 304 and 306 ensure that liquid can flow freely into and out of the upstream chamber 108. The upstream chamber 108 is formed by the upstream conduit 114 expanding into a funnel shaped chamber extending to a shoulder 308 that acts as an overflow by which liquid can overflow from the upstream chamber 108 to downstream liquid handling structures. In this way a set of volume for the liquid in the upstream chamber 108 is defined. The upstream and downstream conduits 114, 116 are configured as described above. Additionally, the downstream conduit 116 extends radially outward from an radially outermost aspect of the unvented chamber 112 to facilitate complete emptying of the unvented chamber 112. Complete emptying of the unvented chamber 112 is further facilitated by a rounded shape of the chamber. In the region of the outlet port 154. To provide a relatively large volume for the unvented chamber 112 in a radially compact manner, the unvented chamber 112 comprises a first portion 310 elongated in a radial direction connected to a second portion 312 elongated in an approximately tangential direction in an L-shaped configuration. It will be appreciated that these features are equally applicable to any other embodiments described herein.

In some embodiments, whether configured in a disc-shape or otherwise, the device 100 is manufactured by forming the liquid handling structures (channels, conduits, etc) in a substrate, for example by injection moulding or stamping the substrate. The liquid handling structures, in some embodiments, include liquid handling structures dimensioned as microfluidic liquid handling structures. The substrate is then sealed by bonding a polymer film to the surface in which the liquid handling structures are defined, with appropriate cut-outs for fluidic access to the liquid handling device, for example to supply or retrieve liquid, as required. In other embodiments, the device may be formed by bonding together two substrates, which may both define respective liquid handling structures, for example, in cooperation, or by a sandwich of a bonding film between to substrates, as will be apparent to the person skilled in the art. It will further be apparent to a person skilled in the art that, while the above embodiments have been described with very simple liquid handling structures downstream of the liquid flow control device 106, the downstream structures may be of any desired complexity and implement functions, such as mixing, aliquoting or containing liquid for detection and/or measurement, for example by fluorescence, turbidity, absorption, surface plasmon resonance, or other effects.

Figure 6:
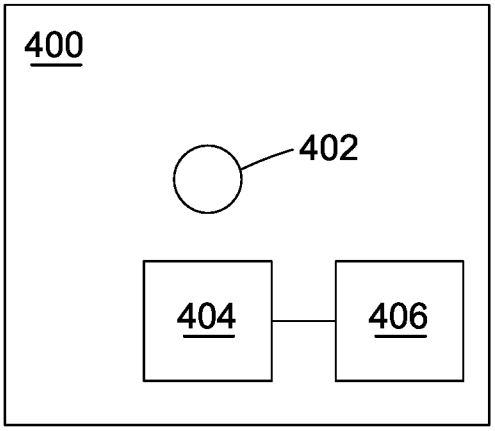
FIG. 6 illustrates a system for driving liquid flows in the liquid handling device.

With reference to FIG. 6, a system 400 for driving liquid flows in a device 100 in accordance with the various embodiments described above comprises a device engaging feature 402, for example a spindle with spring-loaded prongs for engaging a corresponding feature of the device 100, for example configured like the engaging feature 200 described above, a tray and hub arrangement or any other arrangement for engaging the device 100, for example, as commonly found in CD or DVD drives. The engaging feature 402 is coupled to an electric motor 404, which is controlled by a controller 406 configured to implement rotational speed protocols to drive, start, stop and sequence liquid flows as described above.

Figure 7:
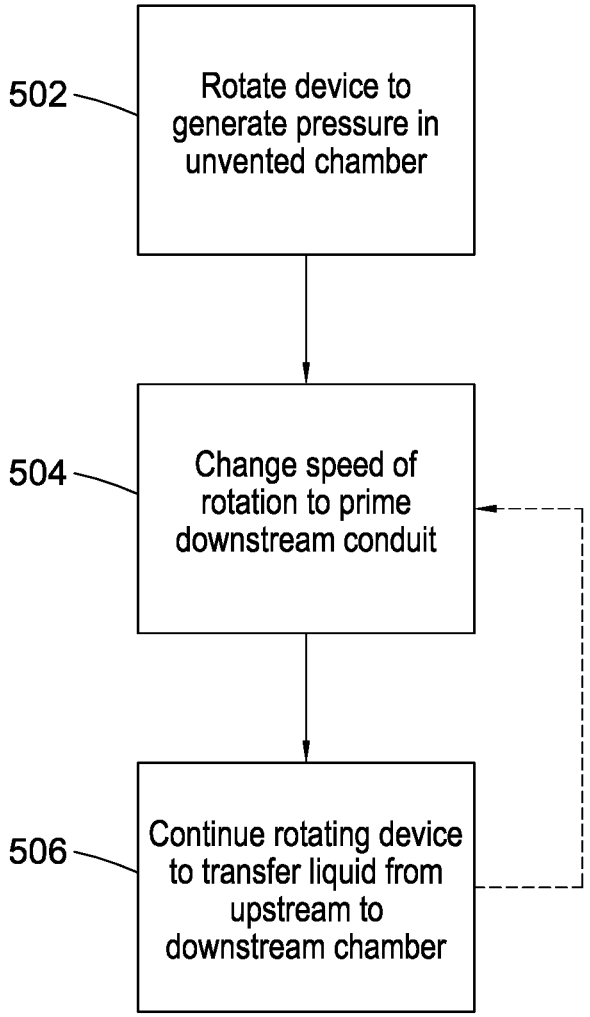
FIG. 7 illustrates a method for driving liquid flows in the liquid handling device.

Detailed methods of driving liquid flows in the device 100 have been described above. With reference to FIG. 7, an overview of methods, for example implemented by the controller 406, to drive and/or sequence liquid flows is now provided. At a first step 502, the device is rotated to drive liquid flow from the upstream chamber 114 to the unvented chamber 112, thereby generating pressure in the unvented chamber 112 and causing a liquid level to rise in the unvented chamber 112. The pressure rises until an equilibrium between the gas pressure in the unvented chamber 112, and the centrifugal pressures at the inlet and outlet ports 120, 124 is reached, maintaining a liquid level in the unvented chamber 112 radially outward of the inlet port 120.

When liquid is to be dispensed to the downstream chamber 110, the speed of rotation is changed at step 504 to prime the downstream conduit. As described above, the speed may be increased or decreased. In either case, the pressure balance that has been reached at step 502 is upset, causing the outlet conduit 116 to prime.

Rotation is continued at step 506 to transfer liquid from the upstream chamber 108 to the downstream chamber 110. With the downstream conduit 116 primed, the speed at which rotation is continued may be unchanged from step 504, may increase or decrease, or may vary over time. In some embodiments, the liquid level in the unvented chamber 112 is maintained radially inward of the outlet port 124 to ensure complete emptying of the upstream chamber 108.

In embodiments with a plurality of upstream chambers 108 that are to be emptied in a sequence, the control method may loop back to step 504 and change the speed in a way that primes the next downstream conduit 116 (or next set of downstream conduits 116), as described above. Steps 504 in 506 may be repeated until all upstream chambers 108 have been emptied.

Figure 8:
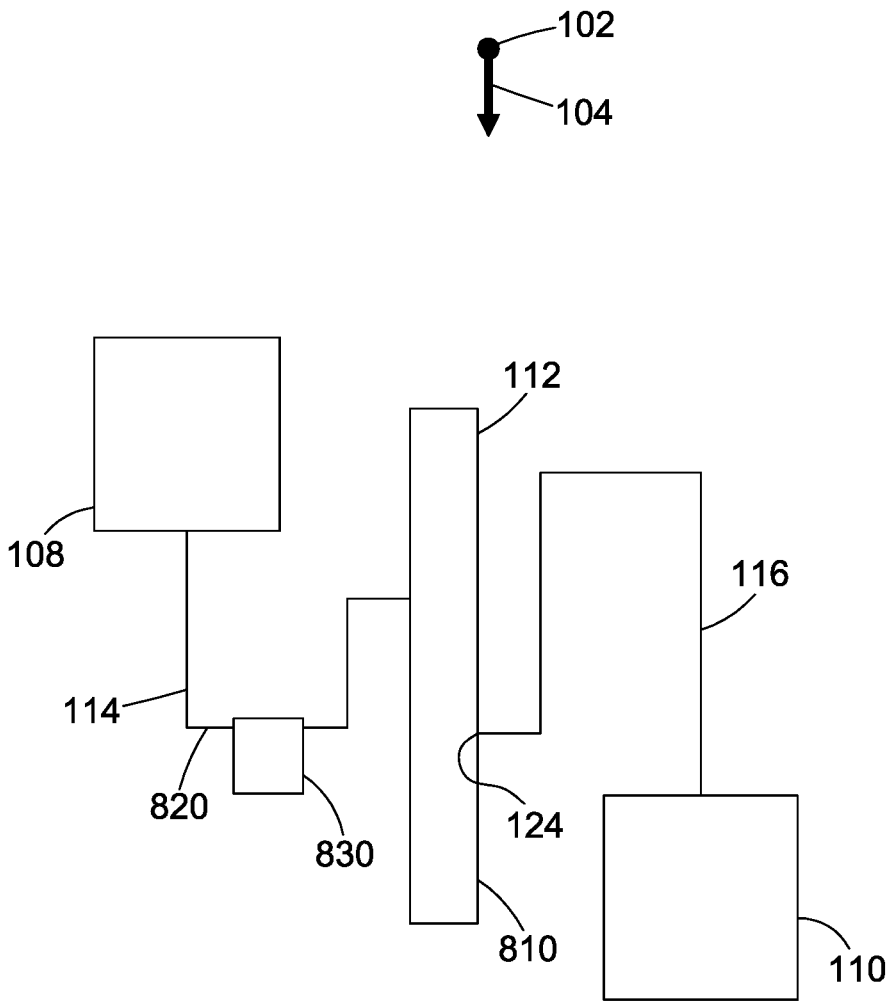
FIG. 8 illustrates variation of the liquid flow control device combining liquid flow control and sedimentation.
Figure 9:
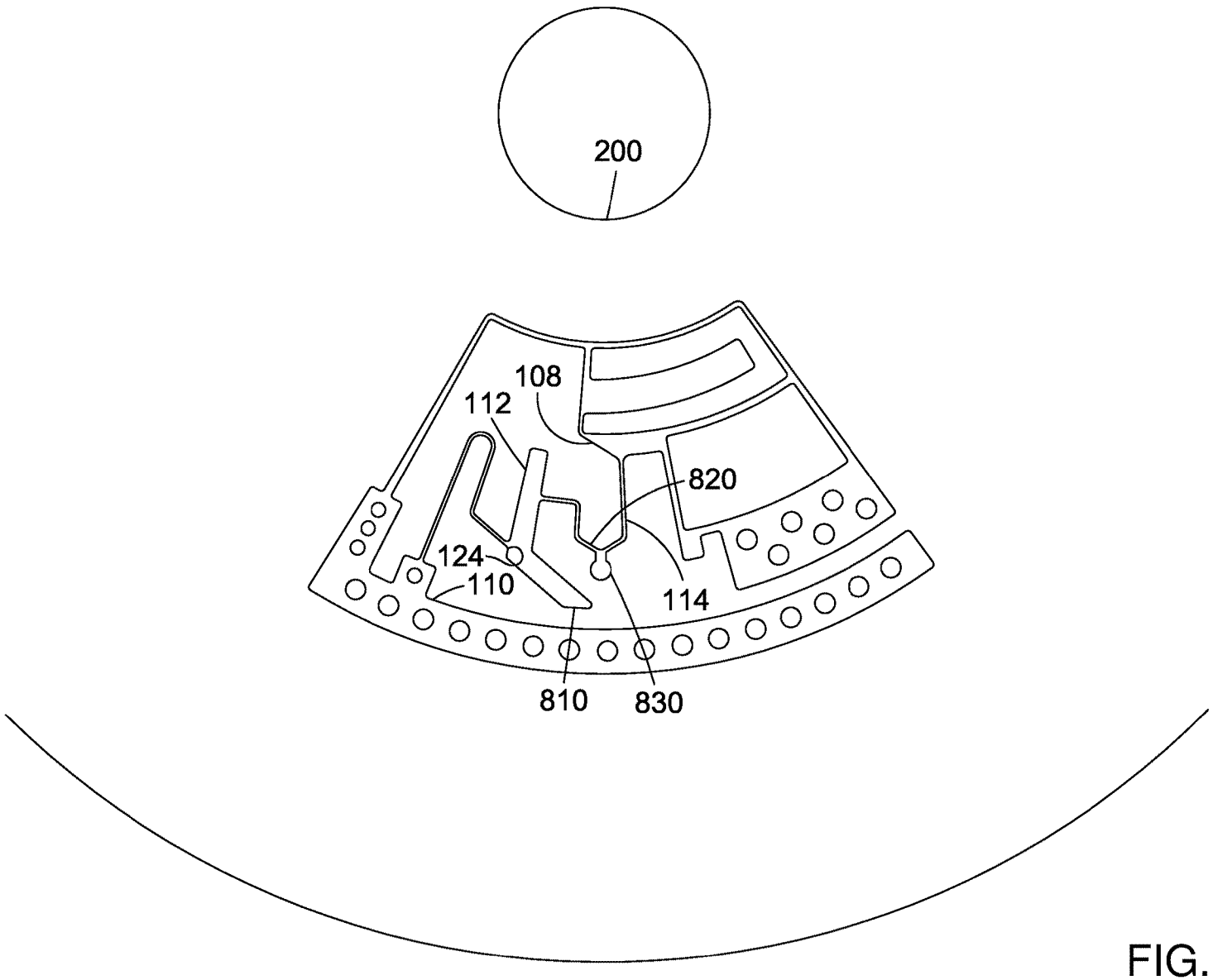
FIG. 9 illustrates a specific configuration of the variation of FIG. 8.

With reference to FIGS. 8 and 9, embodiments of the liquid flow control device with integrated sedimentation or phase separation functionality are now described. In these embodiments, the unvented chamber 112 comprises a sedimentation portion 810 extending radially outward of the outlet port 124. Thus, while liquid is held in the unvented chamber 112, as described above, a two or more phase liquid, for example blood from the upstream chamber 108, in the unvented chamber will sediment under the influence of the centrifugal force, with heavier phase(s) settling in the sedimentation portion 810. The sedimentation portion 810 is dimensioned to accommodate all of the heavier phase, for example cellular material of a blood sample, to leave the outlet port 124 in contact with the lighter phase desired to flow downstream, for example plasma. In the example of blood, the sedimentation portion 810 may thus be dimensioned to accommodate, for example, 60% (corresponding to an expected upper limit for the haematocrit) of the total volume of liquid held in the unvented chamber 112 at the operating speed. With reference to FIG. 7, sedimentation occurs during step 502.

To extract the lighter phase (e.g. plasma) to the downstream chamber 110, the speed of rotation is changed, for example slowed, as described above with reference to step 504 in FIG. 7. Slowing the speed is advantageous in that, in addition to expelling the lighter phase through the outlet 124, it also causes liquid in the upstream conduit 114 to be displaced upstream by expanding gas. By arranging the device, in particular conduits 114 and 116 so that the outflow rate from the unvented chamber is faster than the inflow rate, the downstream conduit 116 can be arranged to run dry before liquid from the upstream conduit 114 arrives, thus isolating the separated lighter phase from upstream liquid as the liquid flow control device in effect resets. Alternatively, the device can be arranged so that any liquid from the upstream conduit 114 does not unduly contaminate the lighter phase, for example by arranging the starting liquid in the upstream chamber 108 to be of an appropriate volume.

To reduce the risk of clogging the upstream conduit 114 and/or to remove the heavier phase from flow in the upstream chamber 108 and possibly upstream conduit 114, as well, in some embodiments a sedimentation chamber 830 can be provided in a radially outer aspect of the upstream conduit 114 at a radially outward facing bend 820 in the upstream conduit 114. Specifically with reference to FIG. 9, the sedimentation chamber 830 may be formed by a radially outer wall of the conduit 114 in the region of the bend 820 expanding radially outward.

Further, with specific reference to FIG. 9, the sedimentation portion 810 is angled with an acute angle with respect to a radial direction (as defined relative to the axis of rotation 4/feature 200). In particular, the sedimentation portion 810 extends radially outward of the outlet port of the unvented chamber in a direction forming an acute angle with a radius through the unvented chamber. The angle with the radial direction reduces the distance that cells have to travel inside the liquid to sediment against the outer wall, thereby facilitating sedimentation.

Figure 10:
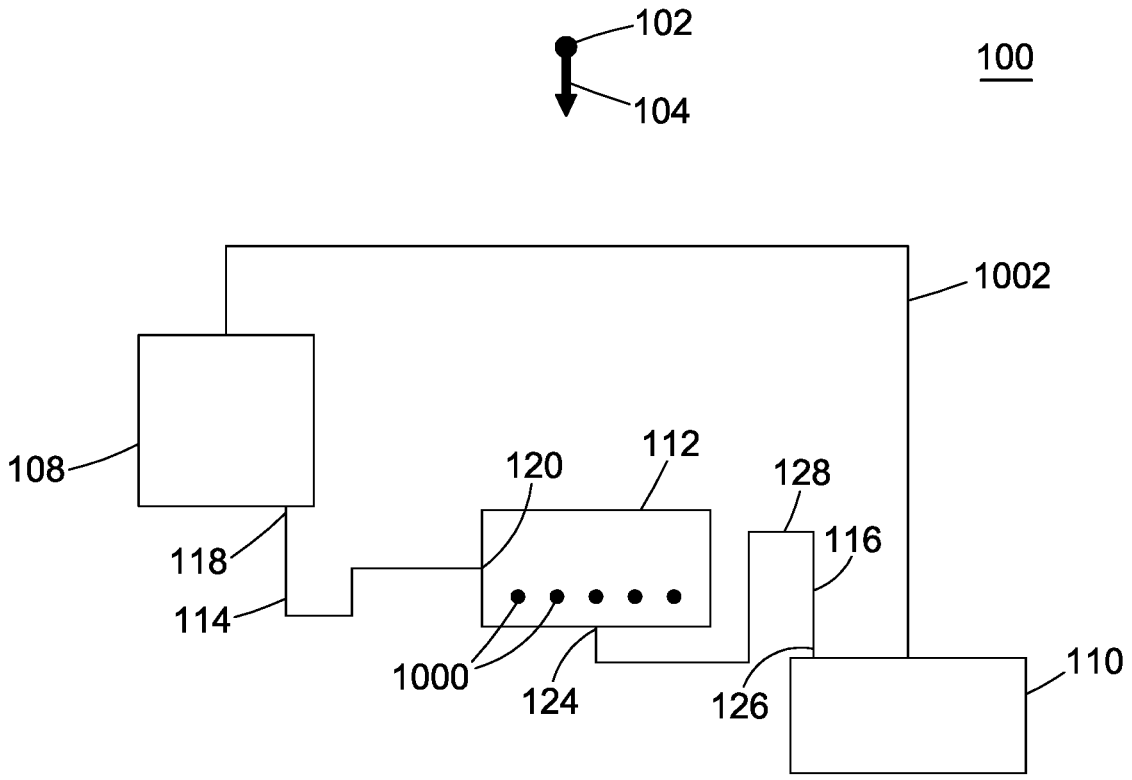
FIG. 10 illustrates a variation of the liquid flow control device in which one or more reagents are disposed in the device.

With reference to FIG. 10, in some embodiments, the device 100 may comprise one or more dry reagents 1000, disposed in the unvented chamber 112. The structure illustrated in FIG. 10 incorporates a number of features described with reference to FIG. 1. Like parts are labelled with like reference numerals and a description of the like parts will not repeated here.

The one or more reagents may be antibodies, enzymes, combined particles (latex beads, nanoparticles), lysing agents or stains, for example, and are disposed radially outwards of the inlet port 120. As liquid enters the unvented chamber, the one or more dry reagents are suspended in the liquid.

The upstream chamber 108 and the downstream chamber 110 are each connected to an air circuit 1002, so that gas pressure can equilibrate as liquid flows in or out of respective inlet and outlet ports of the upstream and downstream chambers. The air circuit 1002 may also be connected to other vented liquid handling structures and/or the atmosphere external to the device 100.

Figure 11:
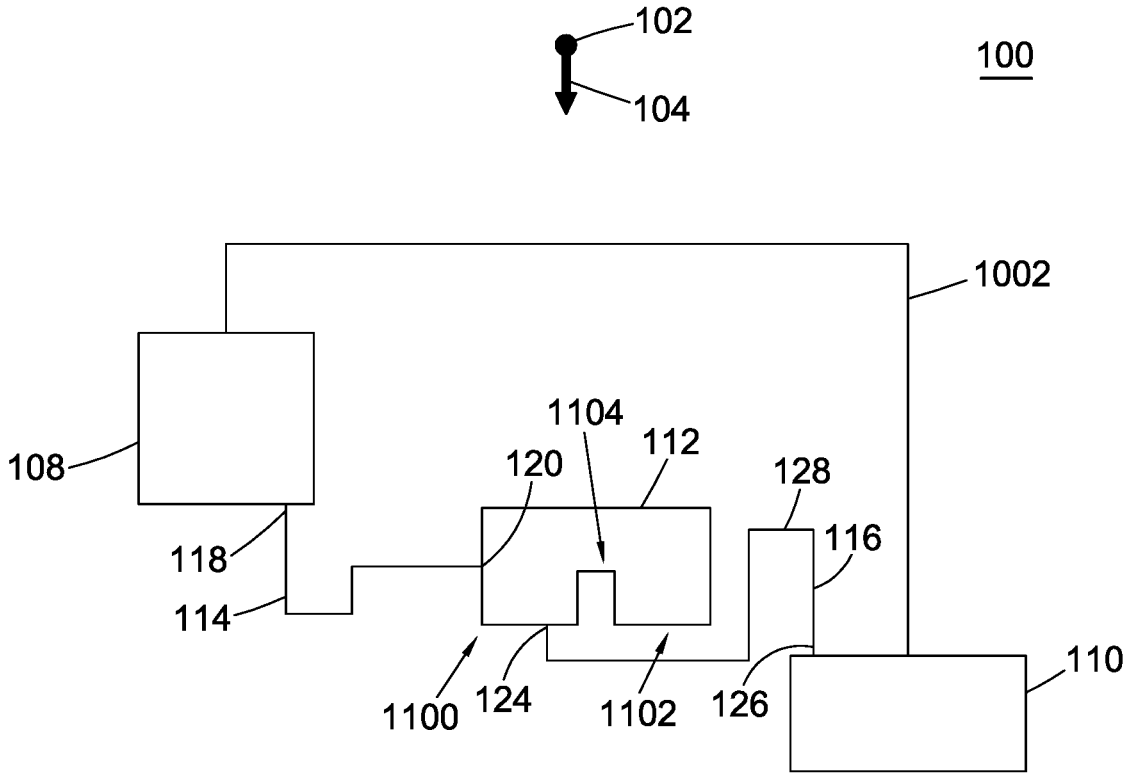
FIG. 11 illustrates a variation of the liquid flow control device in which a volume of liquid may be metered.

With reference to FIG. 11, in some embodiments, the unvented chamber 112 may comprise a first portion 1100 and a second portion 1102. A radially-outer wall of the unvented chamber 112 extends radially inwards to a bend 1104 and then radially outwards from the bend, thus separating the first portion 1100 from the second portion 1102. The outlet port 124 is disposed in the first portion 1100. The inlet port 120 is disposed adjacent to the first portion such that on entering the unvented chamber 112 via the inlet port 120, liquid enters the first portion 1100 and begins to fill the first portion. In some embodiments, the bend 1104 in the wall is radially outwards of the inlet port 120.

As liquid fills the first portion 1100, a fill level of liquid in the first portion rises, i.e. moves radially inwards. Once the liquid level reaches the radial position of the bend 1104, liquid overflows from the first portion 1100 into the second portion 1102. Accordingly, a well-defined volume of liquid (equal to the volume of the first portion) is held in the first portion 1100 and, provided that the volume of liquid in the unvented chamber at any one time does not exceed the combined volume of the first and second portions, the well-defined volume of liquid can be separated from the remaining liquid in the unvented chamber 112. This well-defined volume can then be transferred out of the unvented chamber 112 via the outlet port 124.

In some embodiments, as mentioned above, one or more reagents, for example dry reagents, may be disposed in the unvented chamber 112. In embodiments where the unvented chamber 112 comprises a first portion 1100 and a second portion 1102, the one or more reagents may be disposed in the first portion.

Figure 12:
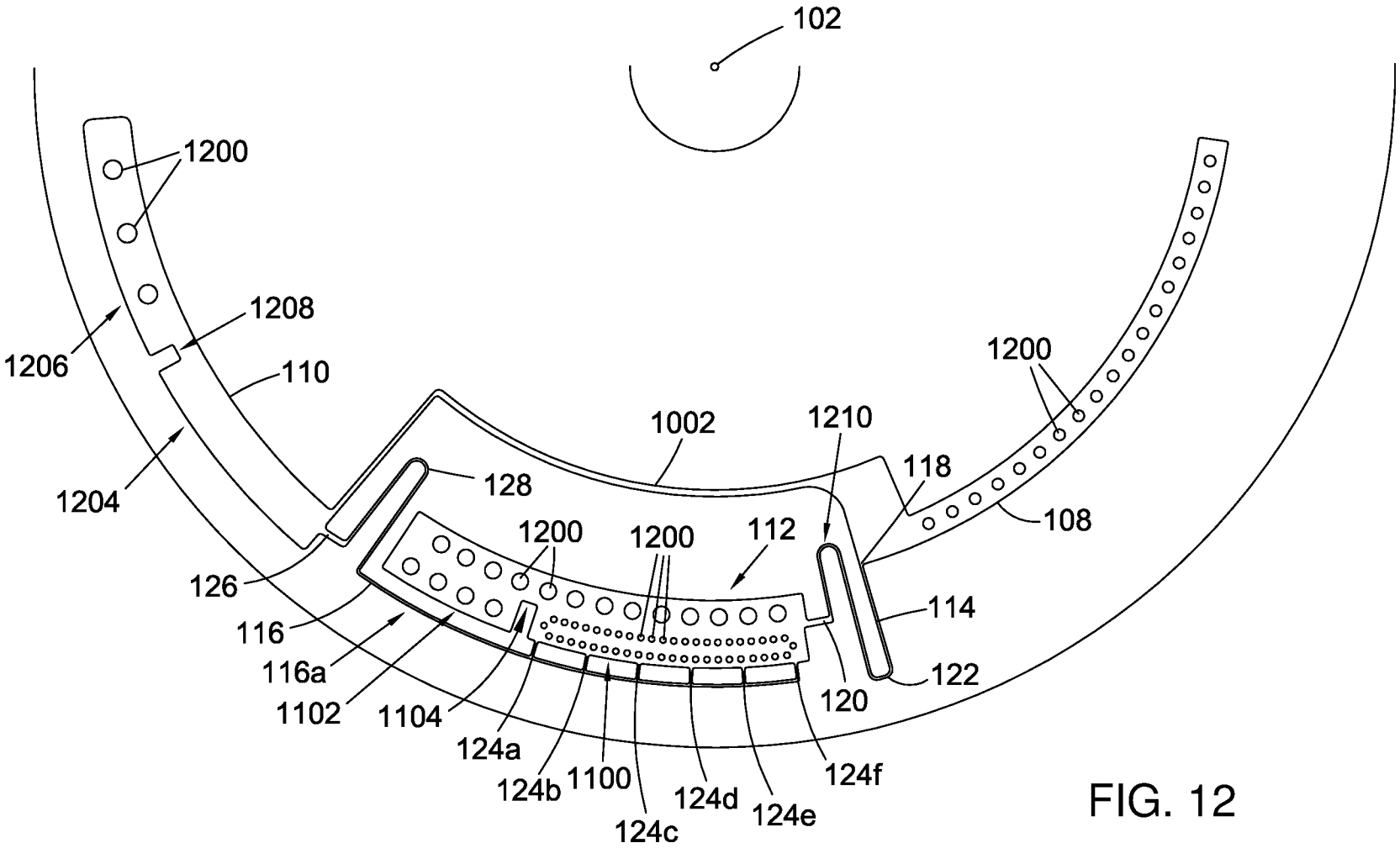
FIG. 12 illustrates a further specific configuration of the liquid flow control device.

It will be appreciated that many of the features of the various embodiments described above may be combined in a number of different ways. With reference to FIG. 12, an implementation of structure shown schematically in FIG. 1, incorporating a number of features described with reference to FIGS. 10 and 11 are described. Like parts are labelled with like reference numerals and a description of the like parts will not repeated here.

With reference to FIG. 12, the upstream chamber 108, the downstream chamber 110 and the unvented chamber 112 each comprise a plurality of pillars 1200, some examples of which (for clarity) are labelled in FIG. 12. The upstream chamber 108 and the downstream chamber 110 are connected to air circuit 1002.

The unvented chamber 112 comprises a first portion 1100 and a second portion 1102. A bend 1104 in the radially-outer wall of the unvented chamber separates the first portion 1100 from the second portion 1102. The inlet port 120 is disposed adjacent to the first portion 1100.

The upstream conduit 114 extends radially inwards from the bend 122 to a crest 1210 and then radially outwards again to connect to the unvented chamber 112. The crest 1210 is disposed radially inwards of a radially-outermost aspect of the upstream chamber 108 and radially outwards of a radially-innermost aspect of the upstream chamber 108. This crest has the effect of delaying the transfer of liquid from the upstream chamber 108 into the unvented chamber 112 until a minimum volume of liquid is present in the upstream chamber 108 and operates as follows. When liquid is transferred into the upstream chamber 108 (from an upstream liquid handling structure, not shown), liquid enters the upstream conduit 114. As the fill level of liquid in the upstream chamber 108 rises, the level of liquid in the upstream conduit 114 also rises to the same radial position as the fill level of liquid in the upstream chamber 108. Accordingly, liquid will only overcome the crest 1210 in the upstream conduit 114 and flow into the unvented chamber 112 when a fill level of liquid in the upstream chamber 108 reaches the radial position of the crest 1210. In this way, liquid only flows into the unvented chamber 112 once a minimum volume of liquid is present in the upstream chamber 108.

The unvented chamber comprises a plurality of outlet ports 124*a-f* which are disposed in the first portion 1100 of the unvented chamber 112. The downstream conduit 116 comprises a common conduit portion 116*a* which is connected to the port 126 of the downstream chamber 110 at one end. The other end of the common conduit portion 116*a* branches into a plurality of conduit portions, which are each connected to a respective outlet port of the unvented chamber 112. As mentioned above, this structure promotes mixing of the reagents with the liquid. It will be appreciated that the unvented chamber may have a plurality of outlets 124*a-f*, as shown in FIG. 12, but may not necessarily have a first portion and a second portion and/or there may or may not necessarily be one or more dry reagents disposed in the unvented chamber 112.

The bend 128 of the downstream conduit 116 is at the same radial position as the crest 1210 of the upstream conduit 114. This is to ensure that, in the unlikely event of the fill level of liquid in the unvented chamber rising to the radial position of the inlet port 120, thus forming a continuous column of liquid between the upstream chamber 108 and the downstream conduit 116, liquid would not be transferred to the downstream chamber 110 before the desired time (i.e. before the device is stopped, sped up or slowed down in order to transfer liquid from the unvented chamber 112 into the downstream chamber 110).

The downstream chamber 110 comprises a first portion 1204 and a second portion 1206. A radially-outer wall of the downstream chamber extends radially inwards to a bend 1208 and radially outwards from the bend, thus separating the first portion from the second portion.

Liquid flows through the structure shown in FIG. 12 in an analogous way to that described above with reference to FIGS. 1-11. Accordingly, a description will not be repeated here.

The above description has been made in terms of specific embodiments for the purpose of illustration and not limitation. Many modifications and combinations of, and alternatives to, the features described above will be apparent to a person skilled in the art and are intended to fall within the scope of the invention, which is defined by the claims that follow.

For example, while conduits have been described above with reference to drawings depicting channel shaped conduits, it will be understood that the term "conduit" covers any arrangement providing a flow path conveying or conducting liquid from one part of the device to another. Accordingly, a conduit with a bend, as described above for the upstream conduit 114 (or the downstream conduit 116), can, for example, be implemented as a bent channel as depicted schematically in the drawings, or more generally as any structure that can contain liquid, has an inlet, and an outlet and is shaped or configured so that liquid flowing from the inlet to the outlet first flows radially outward (or, respectively, inward) to an inflection point and then flows radially inward (or, respectively, outward). The upstream and downstream conduits described herein in various embodiments are thus defined by their function and a shape or configuration necessary to achieve that function, rather than being limited to any specific shape or configuration beyond that which is necessary to achieve the respective described functions.

Likewise, while chambers have been described above with reference to drawings depicting chambers of a certain form factor, it will be appreciated that the disclosure is not so limited and that the described chambers may take any suitable shape or configuration, for example have varying depth, be significantly elongate to resemble a channel, for example a serpentine or meandering channel, be formed by a network of channels or cavities, contain pillars, comprise interconnected volumes, etc. Thus, the upstream, downstream and unvented chambers described herein in various embodiments are not limited by any specific shape or configuration beyond what is necessary to achieve the respective described function of, respectively, providing liquid to the unvented chamber, receiving liquid from the unvented chamber, and containing gas pressurised as a result of displacement by received liquid.

Where methods have been described above that require control of a drive system, the control steps may be implemented in software, hardware or a combination thereof, and may involve a single hardware component such as a general purpose processor or application specific integrated circuit or distributed in any way between a number of processors and integrated circuits. The components of the drive system may be provided in a single device or may be distributed between a number of devices.

The invention claimed is:

1. A method of handling liquids with a device, wherein the device has an axis of rotation about which the device can be rotated to drive liquid flow in the device and comprises:

a vented upstream chamber comprising an outlet port;

an unvented chamber comprising an inlet port to receive liquid from the outlet port of the upstream chamber and comprising an outlet port radially outward the inlet port;

an upstream conduit connecting the outlet port of the upstream chamber to the inlet port of the unvented chamber;

a vented downstream chamber comprising an inlet port to receive liquid from the outlet port of the unvented chamber; and a downstream conduit connecting the outlet port of the unvented chamber to the inlet port of the downstream chamber and comprising a bend radially inward of the outlet port of the unvented chamber, and wherein the method comprises:

rotating the device at a first speed to fill the unvented chamber with liquid from the upstream chamber and compress gas trapped in the unvented chamber while maintaining a level of liquid in the unvented chamber radially outward the inlet of the unvented chamber;

causing liquid to move past the bend of the downstream conduit by stopping the device or rotating the device at a second speed different from the first speed; and continuing to rotate the device to cause liquid to flow from the upstream to the downstream chamber.

2. A method according to claim 1, the method comprising maintaining a level of liquid radially inward of the outlet of the unvented chamber subsequent to liquid flowing past the bend of the downstream conduit while liquid is flowing through the inlet of the unvented chamber.

3. A method according to claim 1, the method comprising maintaining a level of liquid in the vented upstream chamber prior to liquid flowing past the bend of the downstream conduit.

4. A method according to claim 1, wherein a flow rate through the outlet port of the unvented chamber does not exceed a flow rate through the inlet port of the unvented chamber.

5. A method according to claim 1, wherein the upstream conduit comprises a portion radially outward of the inlet port of the unvented chamber.

6. A method according to claim 1, wherein the level of liquid is maintained radially outward the inlet of the unvented chamber at least until liquid moves past the bend of the downstream conduit.

7. A method according to claim 1, wherein the level of liquid is caused to rise to the inlet of the unvented chamber to cause liquid to move past the bend of the downstream conduit.

* * * * *